US007876290B2

(12) United States Patent
Bezal et al.

(10) Patent No.: US 7,876,290 B2
(45) Date of Patent: Jan. 25, 2011

(54) METHOD OF CONTROLLING A MATRIX SCREEN AND CORRESPONDING DEVICE

(75) Inventors: Jean-Raphaël Bezal, Meylan (FR); Eric Cirot, Grenoble (FR)

(73) Assignee: STMicroelectronics S.A., Montrouge (FR)

( * ) Notice: Subject to any disclaimer, the term of this patent is extended or adjusted under 35 U.S.C. 154(b) by 727 days.

(21) Appl. No.: 11/945,804

(22) Filed: Nov. 27, 2007

(65) Prior Publication Data

US 2008/0122743 A1 May 29, 2008

(30) Foreign Application Priority Data

Nov. 29, 2006 (FR) ..... 06 10428

(51) Int. Cl.
*G09G 3/20* (2006.01)
*G09G 3/28* (2006.01)

(52) U.S. Cl. ..... 345/60; 345/55

(58) Field of Classification Search ..... 345/55, 345/60

See application file for complete search history.

(56) References Cited

U.S. PATENT DOCUMENTS 5,852,426 A * 12/1998 Erhart et al. ..... 345/96
6,111,556 A * 8/2000 Moon ..... 345/60
2002/0140367 A1* 10/2002 Matsumoto ..... 315/169.4
2003/0107327 A1* 6/2003 Mas et al. ..... 315/169.3
2005/0057450 A1 3/2005 Jeong
2006/0028402 A1* 2/2006 Gagnot et al. ..... 345/55

FOREIGN PATENT DOCUMENTS

FR 2 872 618 A1 1/2006
WO WO-02/41292 A1 5/2002

OTHER PUBLICATIONS

Zajac, C., "Using Smart Charge Sharing to Reduce Power and Boost Column Driver Performance," National Semiconductor, Application Note 1235, AN200464, May 2002.
Preliminary French Search Report, FR 06 10428, dated Jun. 13, 2007.

* cited by examiner

*Primary Examiner*—Bipin Shalwala
*Assistant Examiner*—Benyam Ketema
(74) *Attorney, Agent, or Firm*—Gardere Wynne Sewell LLP

(57) ABSTRACT

A device for controlling a matrix screen includes a scanning circuit. The scanning circuit includes a row control block which successively selects each row, and a column control block which, for each selected row, selects or deselects a set of columns of the screen with the aid of column selection or deselection signals. The temporal evolution of each column selection signal and of each column deselection signal includes a first and a second part separated by an intermediate porch. The column control block, for each column of the screen, determines if the corresponding column has to be selected or deselected, determines the value of the capacitance seen by the column termed the column-capacitance, and adjusts temporal evolution characteristics of the selection or deselection signal of at least one column to be selected or deselected as a function of the determined value of its column-capacitance.

24 Claims, 22 Drawing Sheets

METHOD OF CONTROLLING A MATRIX SCREEN AND CORRESPONDING DEVICE

PRIORITY CLAIM

The present application is a translation of and claims priority from French Application for Patent No. 06 10428 of the same title filed Nov. 29, 2006, the disclosure of which is hereby incorporated by reference.

BACKGROUND OF THE INVENTION

1. Technical Field of the Invention

The present invention relates to screens in particular plasma screens, and more precisely to the control of the cells of such a screen. However, the use of the invention is not limited to this type of screen. It can be applied for example to screens of liquid crystal type termed "LCDs".

2. Description of Related Art

A plasma screen is a screen of matrix type, formed of cells disposed at the intersections of rows and columns. A cell comprises a cavity filled with a rare gas, and at least two control electrodes. To create a luminous dot on the screen by using a given cell, the cell is selected by applying a potential difference between these control electrodes, then ionization of the gas of the cell is triggered, generally by means of a third control electrode. This ionization is accompanied by an emission of ultraviolet rays. The luminous dot is created through excitation of a red, green or blue luminescent material by the emitted rays.

Conventionally, the control of a plasma screen essentially comprises two phases, namely an addressing phase in which the cells "pixels" which will have to be turned on and those which will have to be turned off are determined, as well as a display phase proper in which the cells that were selected in the addressing phase are read.

The addressing phase comprises sequential selection of the rows of the matrix. By way of example, the unselected rows are placed at a quiescent potential, for example 150 volts, while a selected row is brought to an activation potential, for example 0 volts. To select the chosen pixels of the selected row, the pixels that will have to be turned on by the display phase, the corresponding columns of the matrix are for example brought to a relatively high potential, for example 70 volts, by way of a power stage comprising MOS power transistors. The columns corresponding to the other pixels of the selected row, which will not have to be turned on, are brought to the 0 volts potential. Thus, the cells, which will have to be turned on, of the activated row see a columns-rows potential equal to about 70 volts, while the other cells of this row see a columns-rows potential equal to 0 volts. That said, it is also envisaged, in the addressing phase, by applying different potentials to the rows of the matrix, to apply a high potential to a column so as to select a pixel which will have to be turned off, and to apply a low potential to a column so as to select a pixel which will have to be turned on.

The selection and deselection of the column of the screen can be performed with the aid of a selection and deselection signal generated according to an energy recovery mode, also called the "charge sharing" mode. These modes comprise, for example, the mode commonly dubbed by the person skilled in the art "CSE" ("Charge Sharing Effect") based on the use of a charging capacitor or else the "equalization mode" based on the principle of the flow of the potentials, which is for its part particularly suited to screens of LCD type. For example, the equalization mode consists in connecting the whole set of columns of the screen via their mid-point. Thus, when a column is deselected (therefore prior to the high state with a high value of potential), its potential will automatically flow towards a column to be selected, having a lower value of potential (since it is prior to the low state). Consequently a part of the energy necessary for the selection of a column originates from the columns which are simultaneously deselected.

As a variant, in the course of a selection, during the emission of a column's selection signal, according to the CSE mode, a necessary part of the charge originates from a capacitor incorporated into the control circuit of the screen. This mode is preferably used for plasma screens, but can also be employed for screens of LCD type as described in the document U.S. Pat. No. 5,852,426 (the disclosure of which is hereby incorporated by reference).

Stated otherwise, when a column is selected, part of the charge that is necessary for the formulation of the selection signal is transferred from the aforesaid capacitor to the column to be selected. Once such charge has been transferred, the selection signal has attained a first intermediate porch value, the occurrence of this intermediate porch being characteristic of the selection or deselection signals according to the charge sharing modes. The column control circuit output, coupled to the relevant control, is then switched over to the supply terminal of the circuit, so as to top the amplitude of the selection signal up to its maximum value, in general the value of the supply voltage.

Conversely, when the column is deselected, the output of the column control circuit is then coupled to the charging capacitor so as to charge it by restoring part of the charge to it. The deselection signal therefore goes from its maximum value to the intermediate porch value, then the column control circuit output coupled to the relevant column is switched to the earth of the circuit, in such a way that the deselection signal attains its minimum value.

The CSE mode makes it possible to reduce the energy consumption of the circuit, since part of the charge originates from a capacitor. The energy gain can reach as much as 50% with respect to a circuit operating without this mode.

However, it has been observed that depending on the data displayed on the columns of the screen, the temporal evolution characteristics of the selection or deselection signals vary. These variations can disturb the display of the data on the columns of the screen, and consequently the image displayed. For example, they can bring about a restriction in the time for which the column is kept selected or deselected, it then being possible for this time to be less than the minimum time necessary, to ensure selection or deselection of the column. This problem is particularly frequent when the columns are selected or deselected one after the other according to the mode commonly called "jitter" by the person skilled in the art.

These variations in the temporal evolution characteristics of the selection or deselection signals can also elongate their rise or fall time, to such a point that when switching the relevant column to the supply terminal or to the earth, the selection or deselection signal has not attained the value of the intermediate voltage allowing the realization of the intermediate porch, and therefore the complete discharging or charging of the charging capacitor.

A need exists for a method of controlling a matrix screen, using in particular a charge sharing mode for controlling the columns of this screen, in such a way that the temporal evolution characteristics of the column selection or deselection signals make it possible to select or to deselect the relevant column without disturbing the display of the data.

A further need exists for a method of controlling the columns so as to very precisely adjust the temporal evolution characteristics of their selection or deselection signals.

Yet another need exists for a device making it possible to implement this method, as well as a corresponding screen, in particular a plasma screen.

SUMMARY OF THE INVENTION

In accordance with a first aspect, there is proposed a method of controlling a matrix screen, comprising successive scans of the screen, each scan of the screen comprising a successive selection of the rows of the screen, and for each selected row, a selection or a deselection of a set of columns with the aid of column selection or deselection signals.

According to a general characteristic of this first aspect, the temporal evolution of each selection signal and of each deselection signal of each column comprises a first and a second part separated by an intermediate porch. The method comprises at least for each column to be selected or deselected, a determination of the value of the capacitance seen by the column capacitance column, and an adjustment of the temporal evolution characteristics of the selection or deselection signal of at least one column to be selected or deselected, as a function of the determined value of these column capacitances.

Stated otherwise, at least before each selection or deselection of a column, the column capacitance of the column is determined, then temporal evolution characteristics of the selection or deselection signal of at least one column to be selected or deselected are adjusted, for example the slope value when starting the signal, according to the value of the column-capacitance. Thus, if the value of the column capacitance is high, thereby tending to decrease the slope value of the signal, a setpoint is generated to increase the slope value when starting the signal so as to counteract the effect of a high column capacitance.

Specifically, it is observed that the temporal evolution characteristics specific to the selection or deselection signals generated in the course of the CSE mode are particularly sensitive to the value of the column-capacitance at least of the relevant column.

Consequently, by determining the value of the column-capacitance at least of the relevant column, the temporal evolution characteristics of the selection or deselection signals can, for the CSE mode, be adjusted as a function of the value determined.

Thus, the embodiments make it possible to avoid variations that disturb the display of the data in the case of the use of the CSE mode.

According to a mode of implementation of this aspect, the method can furthermore comprise an adjustment of the temporal evolution characteristics of the selection or deselection signal of the other columns to be selected or deselected, as a function of the value of the column capacitance determined for the column.

Stated otherwise, as soon as a critical value (for example a high value) of column capacitance is determined for a given column, the temporal evolution characteristics of the selection or deselection signal for the whole set of columns of the screen are adjusted as a function of this column capacitance.

As a variant, according to another mode of implementation, the method can comprise an adjustment of the temporal evolution characteristics of the selection or deselection signal of each column to be selected or deselected, as a function of the determined value of its own column capacitance.

This mode of implementation has the advantage of being particularly precise as regards the adjustment of the temporal evolution characteristics of the selection or deselection signal, since the adjustment of the temporal evolution characteristics of the selection or deselection signals of each column depends on its own column-capacitance.

Additionally, it is possible to adjust temporal evolution characteristics of the selection or deselection signals at least of the column to be selected or deselected if the value of its column capacitance lies in a chosen span of values.

Thus, it is possible to determine several spans of values corresponding, for example, to a low, average or high column capacitance value, depending on whether this column-capacitance lies between two determined values.

As a variant, it is possible to adjust the temporal evolution characteristics of the selection or deselection signals at least of the column to be selected or deselected if the value of its column capacitance is greater than a chosen threshold.

For example, if the value of the column capacitance of the relevant column is greater than 60 pF (this value can be stored within storage means associated with the screen ECR but not represented for the sake of simplification), an adjustment of the temporal evolution characteristics of the selection or deselection signals is undertaken, and if the value of this column capacitance is less than 60 pF, the original selection or deselection signals are preserved.

The adjustment of the temporal evolution characteristics of the selection or deselection signals can comprise an increase or a decrease in the duration of the portion comprising the first part and the intermediate porch of the relevant selection or deselection signal.

According to another example, the adjustment of the temporal evolution characteristics of the selection or deselection signal can comprise an increase or a decrease in the absolute value of the slope value of the first respective parts of the relevant selection or deselection signal.

In the case where for a selected row, each selection or deselection signal is furthermore emitted successively with a chosen lag between the starts of two successive signals, the adjustment of the temporal evolution characteristics of the selection or deselection signal can also comprise the zeroing of the successive lags between each selection or deselection signal successively emitted.

According to a preferred mode of implementation, the determination of the value of a column capacitance is carried out on the basis of the signals (for example, the column selection or deselection control signals) representative of possible changes of state of the selection or deselection signals of at least the columns flanking the column by taking account of the direction of variation of the selection or deselection signal of the column.

According to another aspect, there is also proposed a device for controlling a matrix screen, comprising scan means comprising a row control block able to successively select each row, and at least one column control block able for each selected row, to select or deselect a set of columns of the screen, with the aid of column selection or deselection signals.

According to a general characteristic of this second aspect, the temporal evolution of each column selection signal and of each column deselection signal comprises a first and a second part separated by an intermediate porch. The column control block comprises, for each column of the screen, determination means able, at least if the corresponding column has to be selected or deselected, to determine the value of the capacitance seen by the column termed column capacitance, and adjustment means able to adjust the temporal evolution characteristics of the selection or deselection signal of at least one column to be selected or deselected, as a function of the determined value of its column capacitance.

According to an embodiment, the adjustment means are able furthermore to adjust the temporal evolution characteristics of the selection or deselection signal of the other columns to be selected or deselected, as a function of the value of the column capacitance determined for the column. As a variant, the adjustment means can adjust temporal evolution characteristics of the selection or deselection signal of each column to be selected or deselected, as a function of the determined value of its own column capacitance.

Additionally, the device can furthermore comprise storage means able to store a span of chosen values. The adjustment means can adjust temporal evolution characteristics of the selection or deselection signals at least of the column to be selected or deselected if the value of its column capacitance lies in the span of stored chosen values.

As a variant, the storage means can store a chosen threshold. The adjustment means can then adjust the temporal evolution characteristics of the selection or deselection signals at least of the column to be selected or deselected if the value of its column capacitance is greater than the stored chosen threshold.

The adjustment means can, for example, deliver an adjustment setpoint, so as to increase or decrease the duration of the portion comprising the first part and the intermediate porch of the relevant selection or deselection signal, as a function of the value determined for the relevant column capacitance.

In this case, the device can furthermore comprise control means coupled upstream of the determination means delivering for each selection or deselection signal, a first and a second signal able respectively to prime the first and the second part of the selection or deselection signal. The determination means are then also capable of formulating for each selection or deselection signal, a third signal delayed with respect to the second signal, the third signal being able to prime the second part of the selection or deselection signal, the adjustment setpoint then being representative of the first signal and of another signal corresponding to the second signal or to the third signal according to the value determined for the relevant column capacitance.

It is also possible, in the case where for a selected row, the column selection block is able to emit each selection or deselection signal successively with a chosen lag between the starts of two successive signals, that the adjustment means deliver an adjustment setpoint so as to zero the successive lags between each selection or deselection signal.

In this case, the device can furthermore comprise control means coupled upstream of the determination means, delivering for each selection or deselection signal, a first and a second signal able respectively to prime the first and the second parts of the selection or deselection signal. Each of the first signals and each of the second signals being respectively delivered successively with the chosen lag between the starts of the two first or of the two second successive signals. The adjustment setpoint is then representative of the first signal and of the second signal of the relevant column, or representative of the first signal of the first column to be selected and of the second signal of the second column to be deselected, according to the value determined for the relevant column capacitance.

Stated otherwise, if the value determined for the relevant column capacitance is high, each selection or deselection signal is primed respectively as a function of the start of the selection signal of the first column and of the deselection signal of the last column.

Additionally, the intermediate porch can be generated with the aid of at least one intermediate transistor comprising a control electrode controlled by a control current with adjustable value. The adjustment means can then be capable of delivering an adjustment setpoint for the value of the current controllable as a function of the value determined for the relevant column capacitance.

In this case, the adjustment setpoint can comprise a first signal representative of a high value of column capacitance and a second signal representative of a low value of the column capacitances. The control electrode of the intermediate transistor is then coupled to a first and to a second current source by way of a first and of a second breaker, respectively controlled by the first and the second signal. The second current source delivers a current having a value less than the value of the current delivered by the first current source. The first signal controls the closing of the first breaker if the determined column-capacitance is high, the second breaker remaining open. The second signal controls the closing of the second breaker if the determined column-capacitance is low, the first breaker remaining open.

According to a preferred embodiment, the determination means are able to determine the value of a column capacitance, on the basis of signals representative of possible changes of state of the selection and deselection signals of at least the columns flanking the column by taking account of the direction of variation of the selection or deselection signal of the column.

In this case, the determination means can comprise auxiliary determination means comprising: a flip-flop receiving a selection or deselection control signal for the relevant column, able to store the state of the relevant column on the basis of the state of the control signal, delivering the stored state of the column for the selection of the following row; and first comparison means able for the relevant column to compare its present state and its state for the row previously selected and stored in the flip-flop, and able to deliver a variable representative of the possible change of state of the selection or deselection signal.

According to another aspect, there is proposed a screen system, in particular a matrix screen, incorporating a control device such as described above.

BRIEF DESCRIPTION OF THE DRAWINGS

Other advantages and features of the invention will become apparent on examining the detailed description of entirely non-limiting modes of implementation and embodiments, and from examining the appended drawings in which.

DETAILED DESCRIPTION OF THE DRAWINGS

Figure 1:
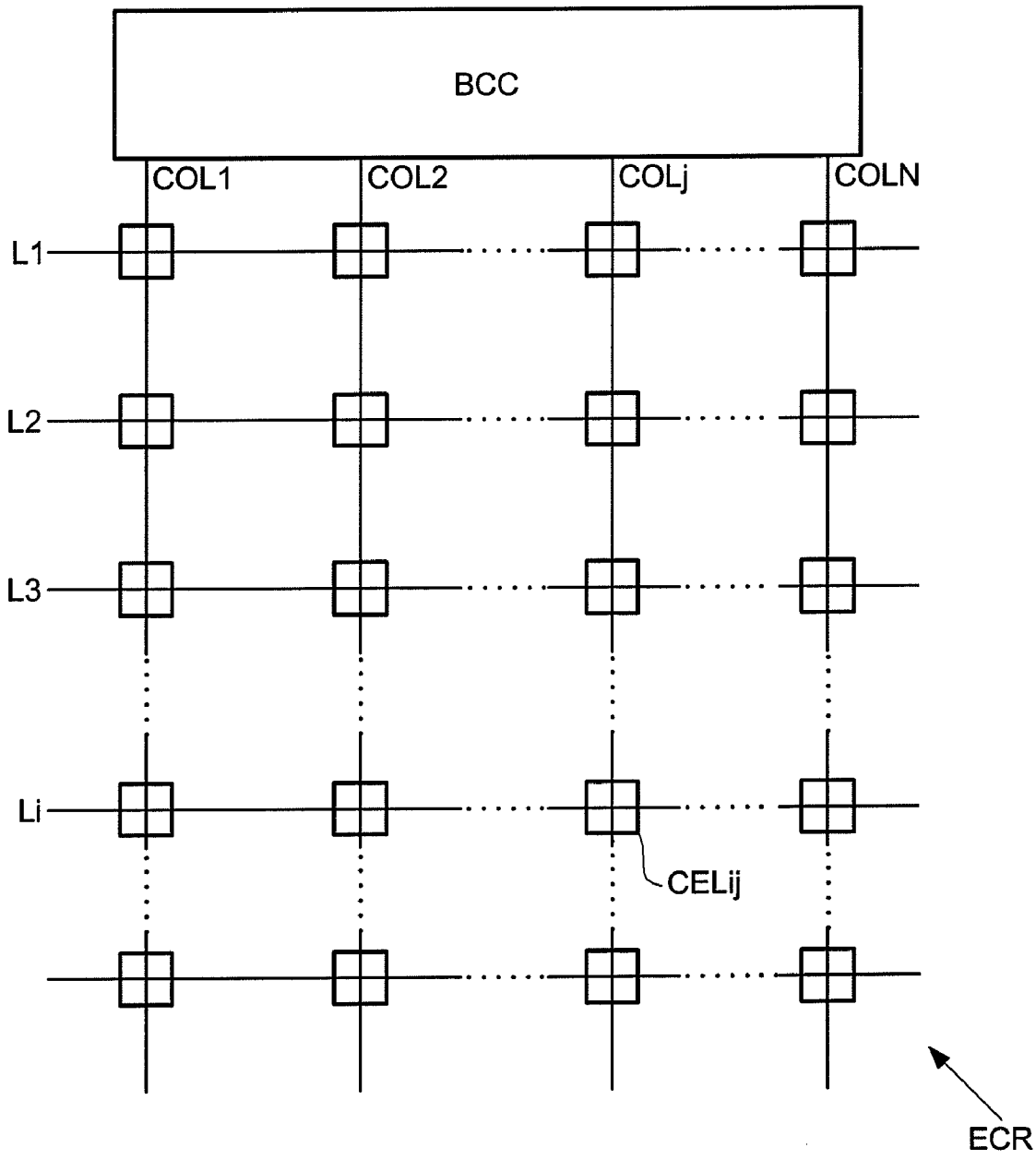
FIG. 1 is a very schematic illustration of a matrix screen according to an embodiment.

FIG. 1 very schematically represents a structure of a matrix plasma screen ECR, formed of a cell CELij (corresponding to pixels of an image). Each cell CELij has two control electrodes respectively linked to Li and to a column COLj, j varying from 0 to N (N being the number of columns of the screen). Each cell has an equivalent capacitance of the order of several tens of pF.

The control device of this screen comprises a row control circuit (not represented for the sake of simplification) able to sequentially select the rows of the matrix, and a column control circuit BCC able to select and deselect several previously deselected or selected columns. These circuits are generally integrated on a semiconductor chip. The control device can comprise several column control blocks, each block being able to control a part of the columns of the screen. A given column control block is coupled with the block controlling the previous columns and the block controlling succeeding columns. Subsequently, unless indicated to the contrary, for the sake of simplification a single control block will be considered for the whole set of columns of the screen. Conventionally, when a column has been selected, its potential is brought to a high value VPP, typically of the order of 70 volts (to turn a pixel on or off according to the embodiment chosen for the screen).

Figure 2:
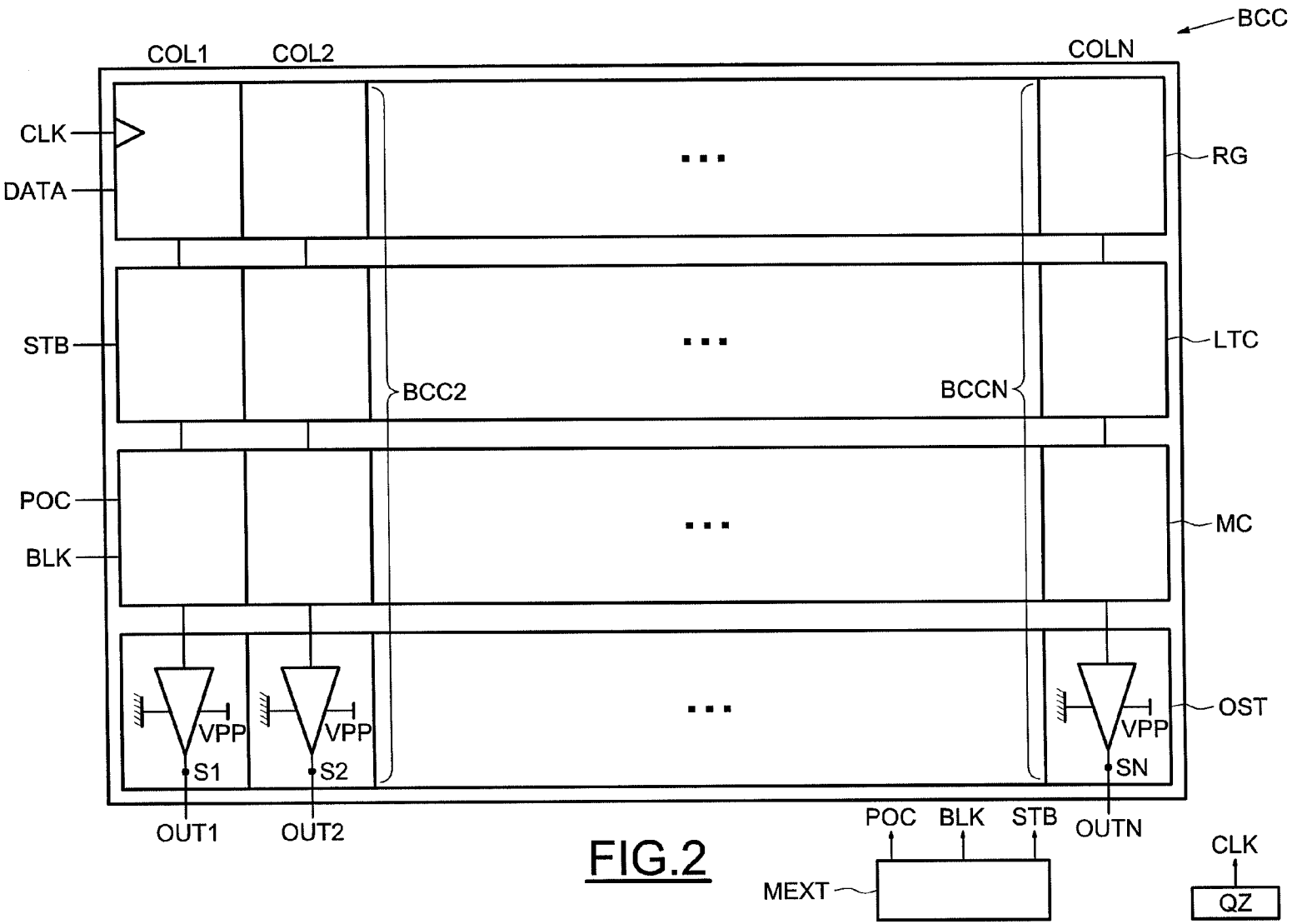
FIG. 2 illustrates an embodiment of a control block for the columns of a matrix screen.

FIG. 2 describes more precisely a column control block BCC according to the invention. Each column of the screen COL1-COLN is controlled by an individual block of columns, respectively BCC1-BCCN. Each individual control block BCC1-BCCN is distributed over four stages.

The first stages of the N individual control blocks are grouped together within a shift register RG and regulated by a clock signal CLK (for example generated by a quartz oscillator QZ). Furthermore, the register RG receives, as input, binary data referenced DATA intended in particular to possibly select or deselect columns which have been previously deselected or selected, when the previous row was selected.

The second stages of each individual control block are grouped together within a latch-memory LTC controlled by an activation signal STB ("Strobe") taking the value "1" throughout the selection and deselection phase proper, with the exception of a pulse of "1" at "0" at the beginning of each selection or deselection signal.

The third stages with each individual control block are grouped together within drive means MC, controlled by combinatorial logic signals comprising a signal BLK and a signal POC.

The signals BLK, POC and STB are delivered by external means MEXT, an embodiment of which will be described in greater detail hereinafter.

The fourth stages of each individual control block are grouped together within an output stage OST.

Conventionally, for each column COL1-COLN, the output stage OST is supplied by a supply voltage VPP (for example, 70 volts) on the one hand, and earthed (grounded), on the other hand (0 volts). The output stage OST delivers for each column COL1-COLN a selection or deselection signal, respectively OUT1-OUTN via the outputs S1-SN. The column selection signals may or may not be emitted simultaneously ("jitter").

Figure 3:
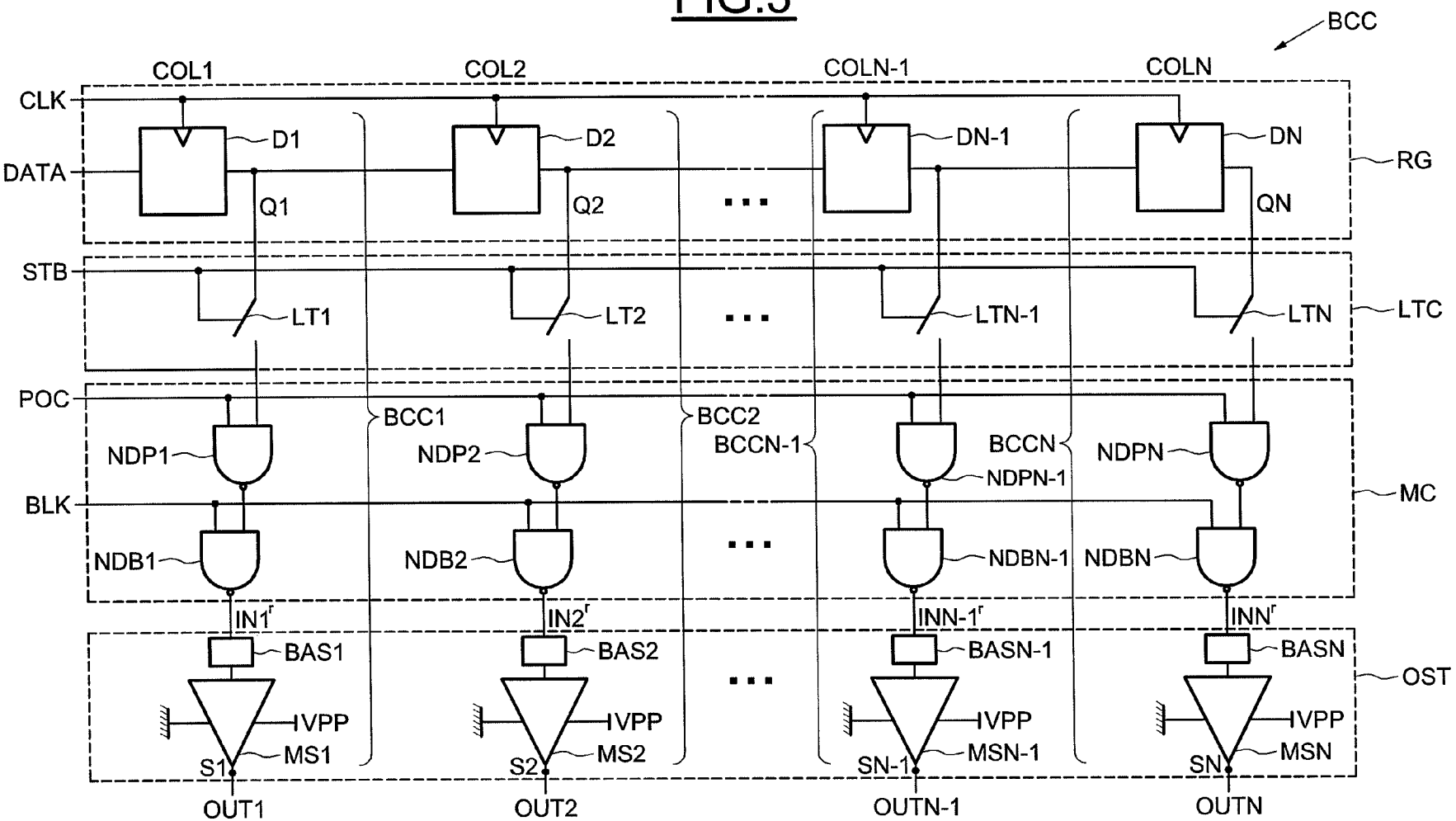
FIG. 3 more precisely illustrates the control block for the columns of the matrix screen represented in FIG. 2.

More precisely, as represented in FIG. 3, the shift register RG comprises a set of N flip-flops D1-DN, connected in cascade, for example D-type flip-flops. Each control block of individual columns BCC1-BCCN comprises respectively a flip-flop D1-DN. Each flip-flop Dn, n varying between 1 and N, receives as input the output signal Qn−1 delivered by the flip-flop Dn−1 connected upstream, and delivers the signal Qn as output to the flip-flop Dn+1, according to the timing of the clock signal CLK.

The first flip-flop D1 receives for its part the binary data DATA. The data of each flip-flop D1-DN are firstly transmitted to the flip-flop D1, then transferred at each clock tick from flip-flop to flip-flop up to the flip-flop corresponding to the data.

Furthermore, the outputs of each flip-flop D1-DN are linked to the latches LT1-LTN, respectively associated with the columns COL1-COLN. The latches LT1-LTN form the latch-memory LTC. They are controlled by the signal STB, so as to simultaneously deliver their output signal as soon as the flip-flops D1-DN have received the data corresponding to their respective columns COL1-COLN.

More particularly, each signal Q1-QN of each column COL1-COLN is transmitted to a logic gate of "NOT AND" type respectively connected to the corresponding latch, the set of these "NOT AND" logic gates being referenced NDP1-NDPN. Each gate NDP1-NDPN also receives the signal POC on its other input. The output of each gate NDP1-NDPN of the drive means MC is linked to another logic gate of the "NOT AND" type, respectively NDB1-NDBN, also forming part of the drive means MC. Each gate NDB1-NDBN receives the signal BLK on its other input. The gates NDP1-NDPN and NDB1-NDBN form the drive means MC. When the signals POC and BLK pass to the high state, the drive means MC deliver the control signals IN1$^r$-INN$^r$ of the columns COL1-COLN to the output stage OST. Each output of the gates NDB1-NDBN is linked to N inputs of the output stage OST, and more particularly to N column selection or deselection means MS1-MSN, via an auxiliary output block BSA1-BSAN, which will be described more precisely hereinafter.

For a given selected row Lr and for each column, the drive means MC deliver a selection or deselection control signal to the output stage.

Figure 4A:
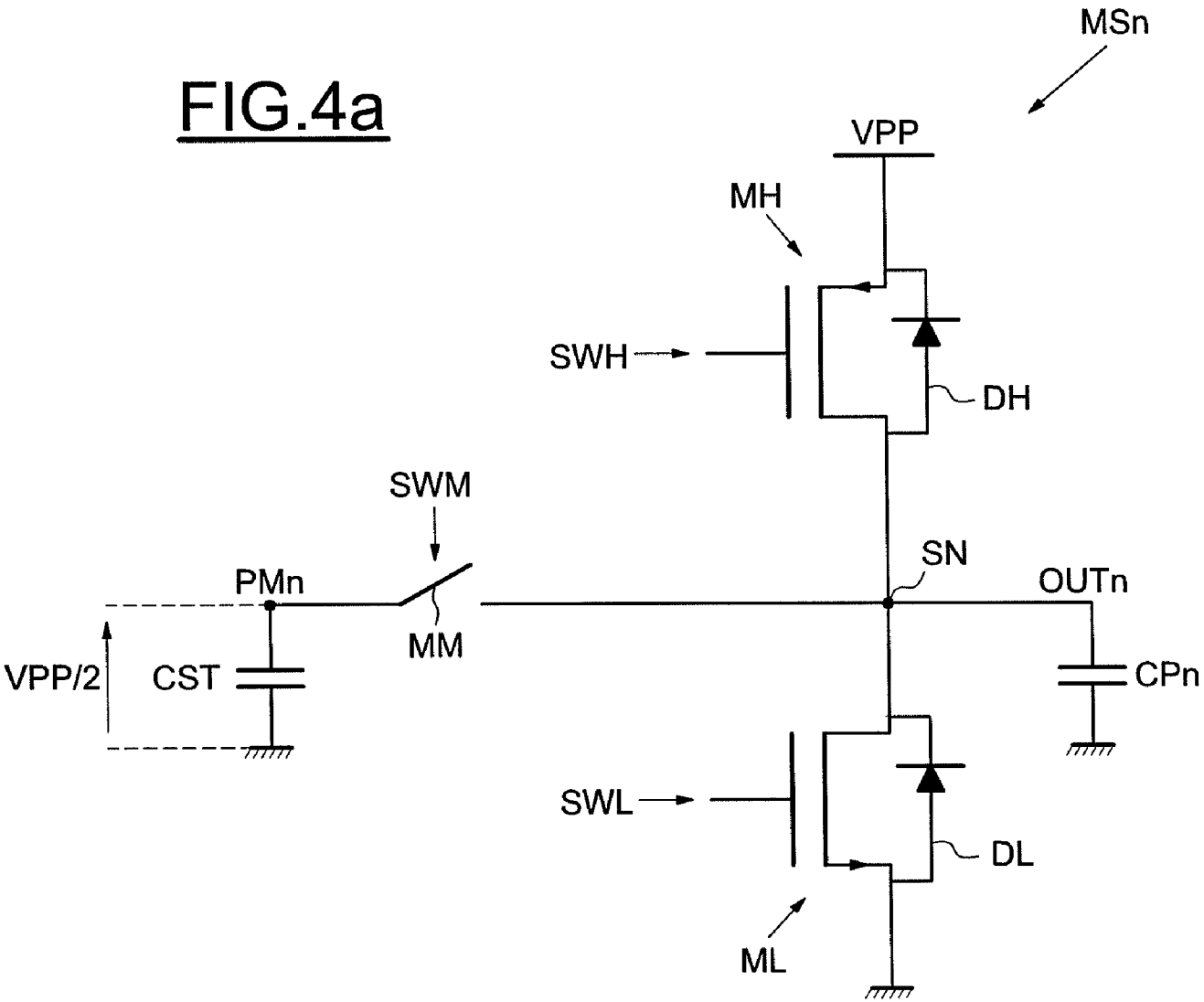
FIG. 4*a* more precisely illustrates control means for the column control block able to implement the CSE mode.

The main characteristics of the selection or deselection means MS1-MSN are briefly recalled in the case of a column control block able to operate according to the CSE mode. To do this, reference is made more particularly to FIG. 4*a*. Each selection or deselection means MSn comprises a selection transistor (more generally a selection breaker) MH of PMOS type (but it may be of NMOS type in another application type), receiving on its source the supply voltage VPP. Its drain is connected to the output Sn of the means MSn. Furthermore, the transistor MH is controlled on its gate by a signal SWH delivered by the auxiliary output block BSAn.

Preferably, a protection diode DH is connected between the source and the drain of the transistor MH. In the case where the transistors are formed within a pit (well), this diode can be the diode intrinsic to this pit.

A deselection transistor of NMOS type, referenced ML (more generally a breaker) is connected between the output Sn and the earth, respectively by its drain and by its source. The transistor ML is commanded on its gate by a signal SWL delivered by the auxiliary output block BSAn. A protection diode DL is connected between its source and its drain. In the case where the transistors are formed within a pit, this diode can be the diode intrinsic to this pit.

The means MSn also comprise a capacitor CST corresponding to the charging capacitor of the CSE mode as explained above. A first terminal of this capacitor CST is earthed, and the value of the voltage across its terminals attains an intermediate value, here VPP/2 when it is charged. Generally, the intermediate value can be equal to: k1·VPP/k2, k1 and k2 being integers.

A breaker MM (that may be embodied, for example, with the aid of transistors of MOS type), is connected between the output Sn and the second terminal PM of the charging capacitor CST, commonly called the mid-point. This breaker MM is commanded by a signal SWM delivered by the auxiliary output block BSAn. A capacitor CPn is connected between the output Sn and the earth. More precisely, each column COL1-COLN sees at the output Sn of the means MSn, a capacitance termed "column-capacitance".

Figure 4B:
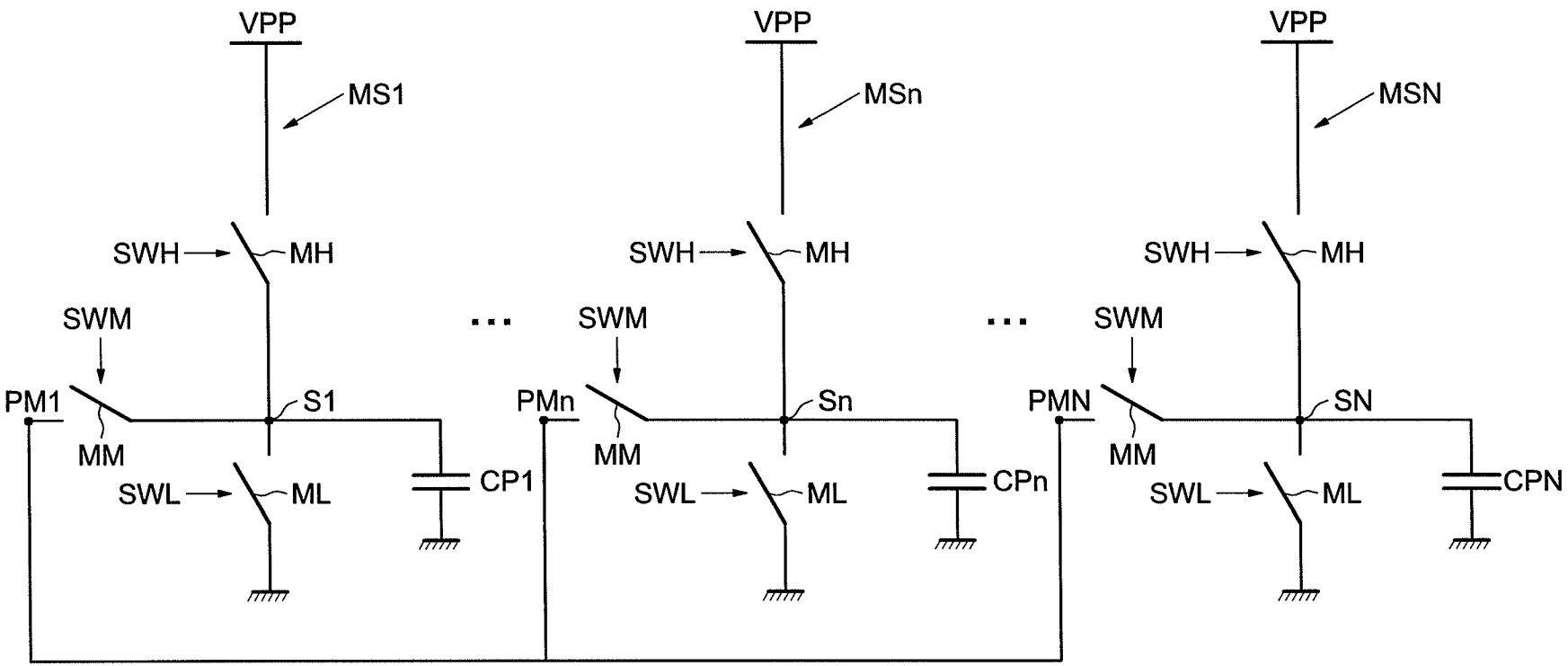
FIG. 4*b* more precisely illustrates control means for the column control block able to implement the equalization mode.

According to another variant, the main characteristics of the selection or deselection means MS1-MSN are briefly recalled in the case of a column control block able to operate according to the equalization mode. To do this, reference is made more particularly to FIG. 4*b*. Just as for the previous FIGURE, the selection means MS1, . . . , MSn, . . . , MSN comprise breakers MH and ML able to select or deselect the corresponding column. A breaker MM makes it possible to perform the energy transfer specific to the charge sharing mode. In this variant, no charging capacitor is used, but all the mid-points PM1, . . . PMn, . . . PMN of the columns are connected together, allowing the flow of the potentials between the columns to be deselected and the columns to be selected as explained above.

Figure 5:
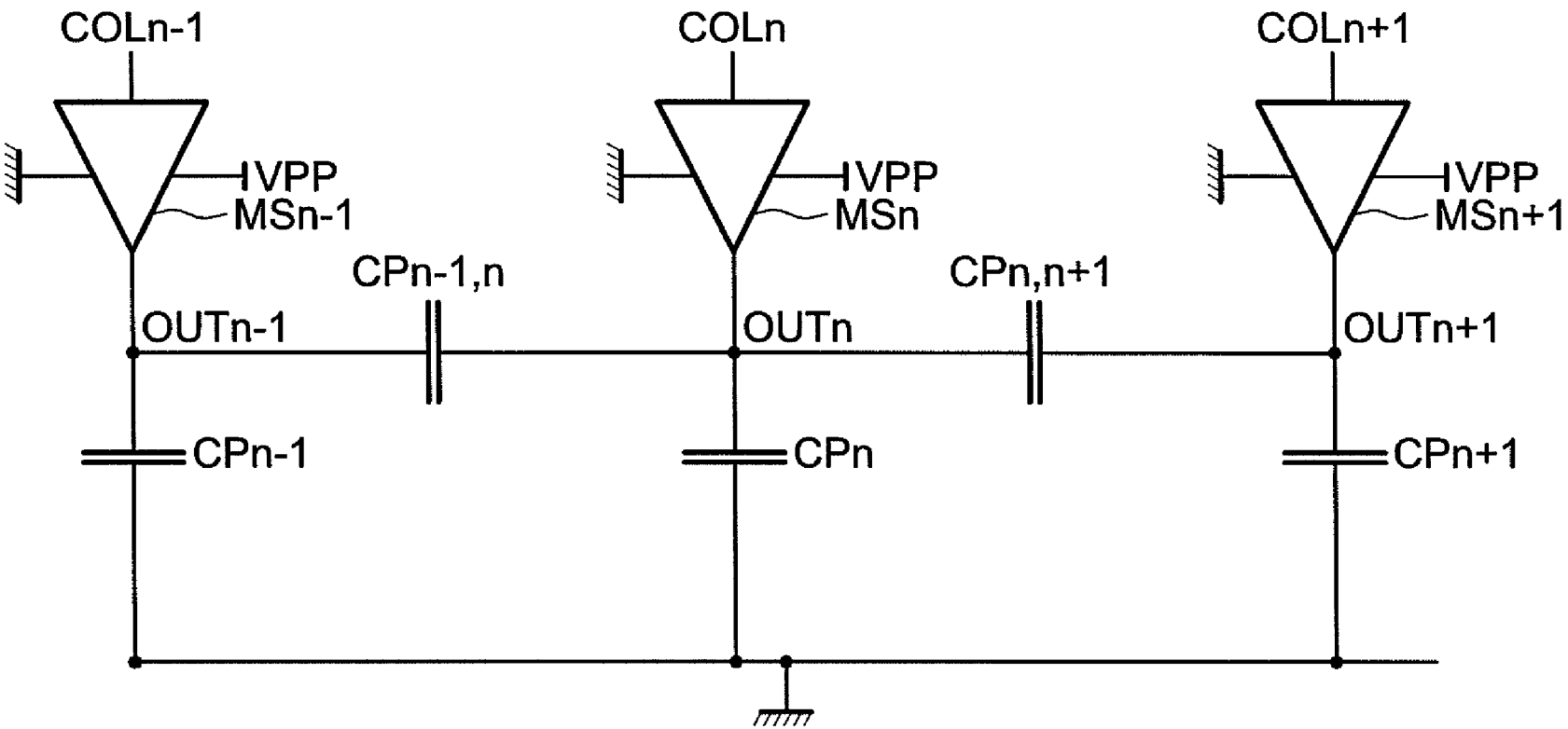
FIG. 5 represents the capacitance seen by a given column.

Additionally as illustrated in FIG. 5, within the screen, the column-capacitance seen by the column COLn comprises the capacitance (for example 30 pF) of the capacitor CPn connected between the output of the selection and deselection means MSn and the earth, as well as the capacitance of the coupling capacitors CPn−1,n and CPn,n+1, respectively connected between the columns COLn−1 and COLn, and COLn and COLn+1.

The value of the column-capacitance of the column COLn varies according to the state of the columns COLn−1 and COLn+1, or indeed even, as observed by the inventors, according to the transitions of the selection or deselection signals of these columns, as described in greater detail hereinafter. Specifically, if it is considered, by way of example, that the column COLn is deselected, and if various possible transitions for the column selection or deselection signals COLn−1 and COLn+1 are envisaged, it is seen as indicated in the table below, that the value of the column capacitance of the column COLn varies between 30 pF and 90 pF, in steps of 15 pF (the person skilled in the art will be able to make the same observations in the case of a selected column COLn).

| OUT n − 1 | OUT n | OUT n + 1 | Column-capacitance: CPn − 1, n + CPn + CPn, n + 1 |
|---|---|---|---|
| ↓ | ↓ | ↓ | 0 + 30 + 0 = 30 pF |
| ↓ | ↓ | L | 0 + 30 + 15 = 45 pF |
| ↓ | ↓ | H | 0 + 30 + 15 = 45 pF |
| L | ↓ | L | 15 + 30 + 15 = 60 pF |
| H | ↓ | H | 15 + 30 + 15 = 60 pF |
| L | ↓ | H | 15 + 30 + 15 = 60 pF |
| ↓ | ↓ | ↑ | 0 + 30 + 2 × 15 = 60 pF |
| H | ↓ | ↑ | 15 + 30 + 2 × 15 = 75 pF |
| L | ↓ | ↑ | 15 + 30 + 2 × 15 = 75 pF |
| ↑ | ↓ | ↑ | 2 × 15 + 30 + 2 × 15 = 90 pF |

In the table above, the letter H indicates that the relevant column remains in the high state, the letter L indicates that the relevant column remains in the low state, the sign ↑ indicates that the relevant column goes from the low state to the high state (case of a selected column, while it was in the low state), the sign ↓ indicates that the relevant column goes from the high state to the low state (case of a deselected column, while it was in the high state).

Specifically, it has been observed that the value of the capacitance of the coupling capacitors CPn−1,n and CPn,n+1 is seen by the column COLn, if there is a variation in the voltage across the terminals of these capacitors. Thus, if the columns COLn and COLn−1 are simultaneously selected whereas beforehand they were in the low state, the potentials OUTn−1 and OUTn will vary in the same way and simultaneously. No voltage variation will therefore appear across the terminals of the capacitor CPn−1,n. Consequently, depending on the transitions of the columns COLn−1 and COLn+1 with respect to the transition of the column COLn, the value of the column capacitance of the column COLn can take a relatively low value or a relatively high value.

In this example, each variation in potential of one of the terminals of a coupling capacitor brings about a column-capacitance variation of the order of 15 pF. On the basis of the table above, it follows that as soon as one of the columns COLn−1 or COLn+1 is selected, the value of the column-capacitance seen by the column COLn is high (the value of 60 pF being a threshold value between a low value and a high value of the capacitances). Conversely in the case of a selected column COLn, as soon as at least one of the columns COLn−1 or COLn+1 is deselected, the value of the column capacitance seen by the column COLn is high.

On the basis of this observation, a set of equations have been defined governing the determination of a low or high value of a column-capacitance, on the basis of the changes of state of the selection or deselection signals for the columns flanking the relevant column. This way of determining the value of a column-capacitance of a given column is used preferably, given that the latter is particularly precise as regards the determined value of the column capacitance. However, the person skilled in the art can use any other column capacitance determination procedure, such as for example that described by patent application US 2002/0140367 or else in international application WO 02/41292 in the name of the Applicant (the disclosures of which are hereby incorporated by reference herein).

The equations corresponding to the preferred mode of calculating the column-capacitance take into account only the columns COLn−1 and COLn+1 when determining the value of the column capacitance of the column COLn. However, by extension, it is also possible to consider the columns COLn−k, k varying from 1 to N−1, their influence on the value of the column capacitance of the column COLn being of order k.

Additionally, it is also possible to establish intermediate values of the column capacitances (for example low, average and high), by fixing several thresholds from among the whole set of values that the column capacitance of a column COLn can take.

Figure 6:
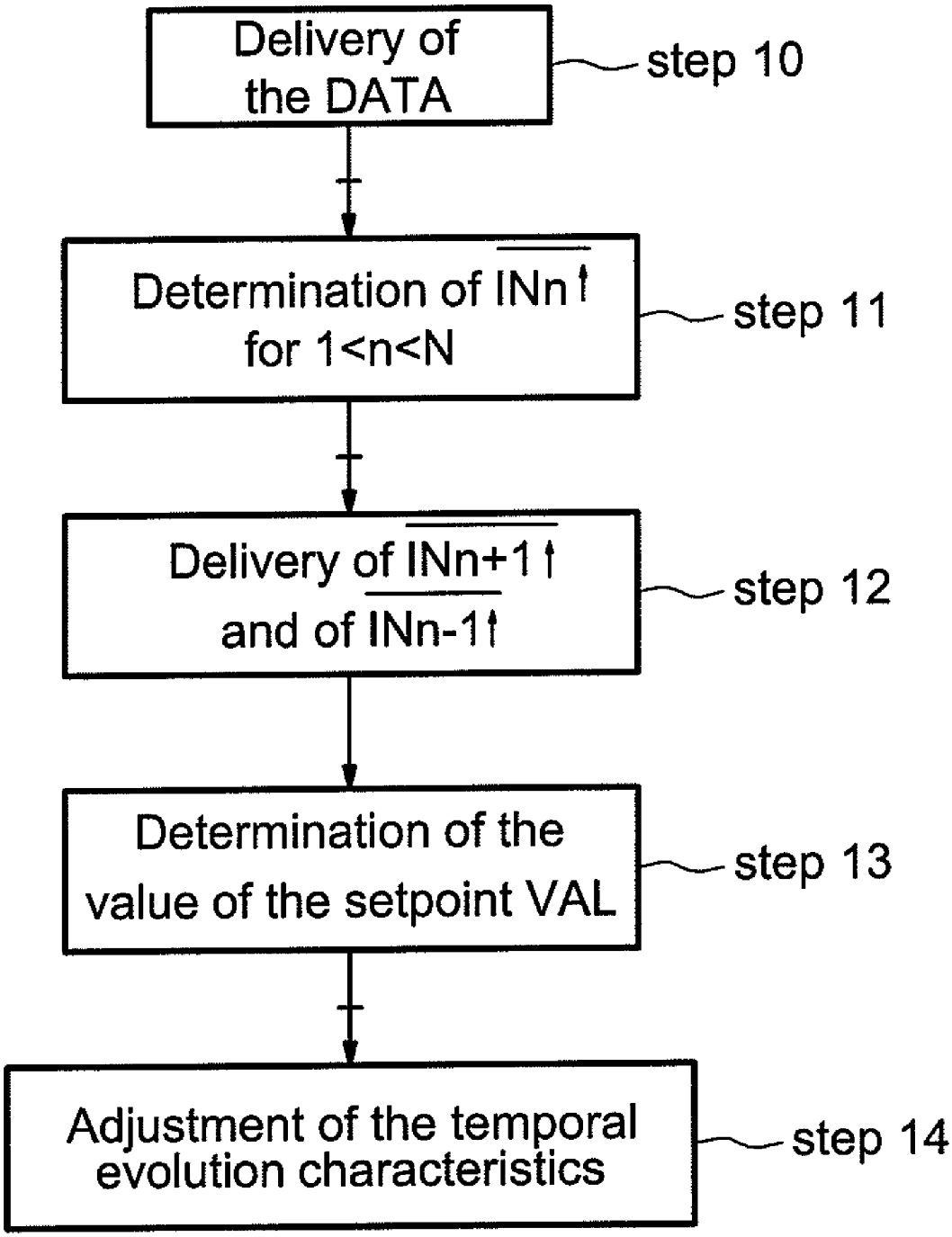
FIG. 6 represents a flowchart of an exemplary implementation of a method.

FIG. 6 illustrates a mode (according to combinatorial logic) of implementing a method for adjusting the temporal evolution characteristics of the selection or deselection signal for a column control block able to operate according to the charge sharing mode. FIG. 6 considers the case of a deselected column COLn. The person skilled in the art will very easily be able to adapt the steps described below, and in particular the equations, to the case of a selected column COLn. This mode of implementation comprises the determination of the column-capacitances according to the preferred mode mentioned above.

A first step (step 10) comprises the delivery of the data DATA to the column control blocks.

Then a signal $\overline{\mathrm{INn}}\uparrow$ is determined (step 11) for the whole set of columns COL1-COLN. Specifically, according to the table presented previously, in the case of a deselection, the column capacitance COLn is high (here greater than or equal to 60 pF), if the signal of at least one of the columns COLn+1 to COLn−1 goes from the low state to the high state.

Stated otherwise, the column-capacitance of the column COLn is high if the selection or deselection signal comprises a rising edge INn↑. This amounts to saying that the column COLn was in the low state (L) when selecting the row Lr−1 and was in the high state (H) when selecting the row Lr, which is expressed by:

$$\mathrm{INn}^{r}\uparrow \Leftrightarrow \mathrm{INn}^{r-1}=\mathrm{L} \text{ and } \mathrm{INn}^{r}=\mathrm{H}, \qquad \text{(equation 1)}$$

that is to say:

$$INn^{r}\uparrow=\overline{INn^{r-1}}\cdot INn^{r} \qquad \text{(equation 1b is),}$$

i.e., by taking the complement, $$\overline{INn^{r}\uparrow} = \overline{\overline{INn^{r-1}}\cdot INn^{r}} \qquad \text{(equation 2)}$$

But, as mentioned above, the value of the column-capacitance seen by the column COLn is high if at least one of the columns COLn+1 or COLn−1 is selected, stated otherwise:

$$INn-1\uparrow \text{ or } INn+1\uparrow \Leftrightarrow \overline{\overline{INn-1\uparrow} \text{ and } \overline{INn+1\uparrow}} \qquad \text{(equation 3)}$$

Consequently, one deduces from equations 2 and 3 above, that the value of the column capacitance of the column COLn is high if:

$$\text{Column-capacitance high} \Leftrightarrow \overline{\overline{\overline{INn-1^{r-1}}\cdot INn-1^{r}}\cdot\overline{\overline{INn+1^{r-1}}\cdot INn+1^{r}}} \qquad \text{(equation 4)}$$

(In the case of a selected column COLn, the dual equation is relevant).

The variables $\overline{\mathrm{INn-1}\uparrow}$ and $\overline{\mathrm{INn+1}\uparrow}$ are therefore used to determine (step 11) whether the column capacitance of a column COLn is high.

The variables $\overline{\mathrm{INn-1}\uparrow}$ and $\overline{\mathrm{INn+1}\uparrow}$ are delivered (step 12) so as to determine (step 13) a signal VAL which is a setpoint for adjusting the temporal evolution characteristics of the selection or deselection signals, if the determined column capacitance is high.

Once this operation has been carried out, the temporal evolution characteristics of the selection and deselection signals in the case of a selection or a deselection according to a charge sharing mode, are adjusted (step 14).

The temporal evolution characteristics of the selection or deselection signals can comprise for example in the CSE mode, the adjustment of the "CSE length" or else the slope value of the deselection or deselection signals when starting the selection or deselection.

The following FIGURES illustrate embodiments in the case where the CSE mode is used. However, these embodiments are not in any way limited to the CSE mode, but can be adapted to any control of the columns of the screen according to a charge sharing mode, such as for example the equalization mode. The person skilled in the art will very easily be able to adapt the examples to the various cases, on the basis of the embodiments described below.

Figure 7A:
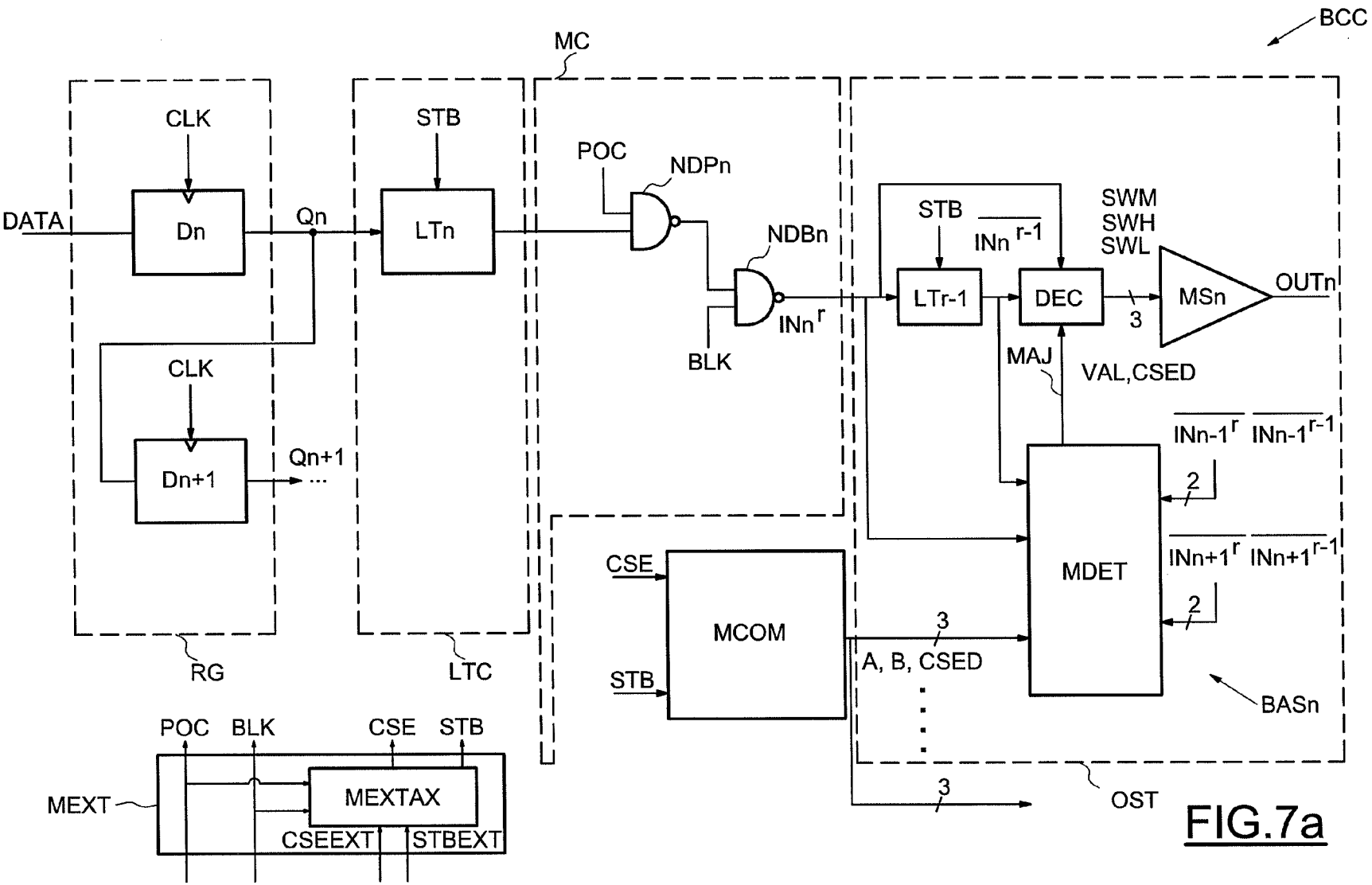
FIG. 7*a* illustrates an embodiment of a part of a column control block for a column n in the case where said block uses the CSE mode.

FIG. 7*a* illustrates an embodiment of a column control block (for a column COLn) capable of implementing a method according to the invention to adjust the "CSE length" of the selection or deselection signals.

The auxiliary output block BASn comprises means MDET for determining the value of the column capacitance for a column COLn, on the basis of the change of state of the columns COLn−1 and COLn+1. As a variant, the determination means MDET can be realized in a software manner.

A latch LTr−1 with inverting output, controlled by the signal STB, is connected to the output of the drive means MC. This latch LTr−1 stores the selection or deselection control signal $\mathrm{INn}^{r}$ of the column COLn, during selection of the previous row. It therefore delivers as output the control signal stored during the selection of the row Lr−1, that is to say $\overline{\mathrm{INn}^{r-1}}$, during the selection of the row Lr.

The signals $\mathrm{INn}^{r}$ and $\overline{\mathrm{INn}^{r-1}}$ are in particular delivered as input for the determination means MDET. The latter furthermore receive the complements of the selection or deselection control signals for the columns COLn−1 and COLn+1, for the rows Lr and Lr−1, that is to say respectively $\overline{\mathrm{INn-1}^{r}}$, $\overline{\mathrm{INn-1}^{r-1}}$, $\overline{\mathrm{INn+1}^{r}}$ and $\overline{\mathrm{INn-1}^{r-1}}$.

Additionally, the determination means MDET are connected to control means MCOM able to activate or otherwise the CSE mode on the basis of the signals CSE and STB.

The signals CSE and STB are formulated by external means MEXT. More precisely, the signals BLK and POC are formulated by a drive component incorporated into the column control block, not represented for the sake of simplification. This drive component also formulates signals CSEEXT is STBEXT respectively representative of the CSE mode and of the signal STB, on the basis of which the signals CSE and STB are formulated by the means MEXT. Accordingly, the means MEXT here comprise auxiliary external means MEXTAX. The latter receive as input the signals POC, BLK, CSEEXT and STBEXT so as to formulate the signals CSE and STB.

Figure 7B:
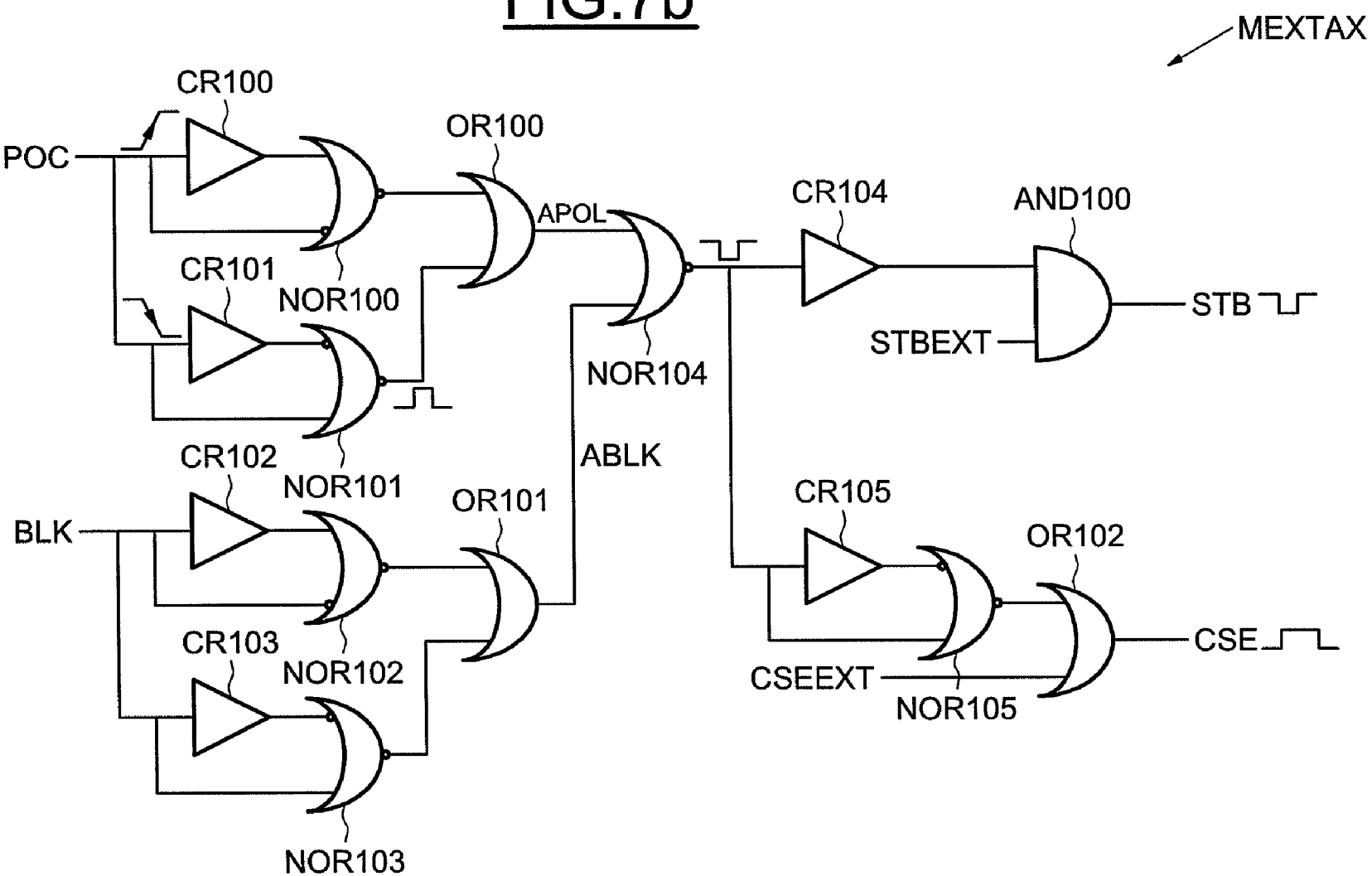
FIG. 7*b* illustrates in greater detail a module of the part of the column control block illustrated in FIG. 7*a;*

FIG. 7*b* illustrates in greater detail a preferred embodiment of these auxiliary means MEXTAX, a function of which is to reinitialize the signals CSE and STB when the signals POC and BLK change state. The means MEXTAX receive the signal POC as input. This signal is delivered as input for a delay cell CR100. The output of this delay cell CR100 is connected to an input of a gate of "NOT OR" type referenced NOR100. The latter also receives, on another input of inverting type, the signal POC.

Another delay cell CR101 receives the signal POC as input. Another gate of "NOT OR" type referenced NOR101 receives on an inverting input the signal delivered by the delay cell CR101. The gate NOR101 also receives the signal POC as input.

The outputs of the gates NOR100 and NOR101 each are connected to the input of a gate of "OR" type referenced OR100. On the basis of the signals delivered as output from the gates NOR100 and NOR101, the gate NOR100 delivers a signal APOC.

Additionally, the means MEXTAX receive the signal BLK as input.

A delay cell CR102 receives the signal BLK as input. Its output is connected to the input of a logic gate of "NOT OR" type referenced NOR102. The latter also receives the signal BLK on an inverting input.

Another delay cell CR103 receives the signal BLK as input. Its output is connected to an inverting input of a logic gate of "NOT OR" type, NOR103. The latter also receives the signal BLK as input. The outputs of the gates NOR102 and NOR103 are each connected to an input of a gate of "OR" type, referenced OR101. This gate OR101 delivers a signal ABLK as output.

The signals APOC and ABLK are delivered as input to a gate of "NOT OR" type referenced NOR104. The output of the gate NOR104 is connected on the one hand to a delay cell CR104 and on the other hand to a delay cell CR105.

The output of the delay cell CR104 is connected to a logic gate of "AND" type referenced AND100. The latter also receives the signal STBEXT as input. It delivers as output the signal STB, which corresponds to the signal STBEXT synchronized with the edges of the signals POC and BLK.

The output of the delay cell CR105 is connected to an inverting input, a logic gate of "NOT OR" type referenced NOR105. The latter also receives on another input the signal delivered by the gate NOR104.

The output of the gate NOR105 is connected to an input of a gate of "OR" type referenced OR102 which also receives the signal CSEEXT as input. This gate OR102 delivers as output the signal CSE synchronized with the signals POC and BLK.

More precisely, when a rising edge of the signal POC occurs, the gate NOR100 delivers a notch whose width is defined by the delay generated by the delay cell CR100.

Conversely, when a falling edge of the signal POC occurs, the gate NOR101 delivers a notch whose width is defined by the delay generated by the delay cell CR101.

The same reasoning applies for the gates NOR102 and NOR103 in relation to the signal BLK. When the signals APOC and ABLK simultaneously take the value "1" (high state in this example), the gate NOR104 goes to "0" (low state in this example). This falling pulse is echoed at the level of the signal STB with a delay generated by the delay cell CR104 with respect to the rising edge of the CSE signal.

Moreover, the pulse generated by the gate NOR104 causes conversely, a CSE notch whose duration is dependent on the delay generated by the cell CR105.

The output of the gate OR102 goes to "1" when the output of the gate NOR105 or the signal CSEEXT goes to "1".

Reference is once again made to FIG. 7*a*. The control means MCOM formulate two signals A and B and another signal CSED dependent on the CSE signal for the whole set of columns of the screen.

Figure 8:
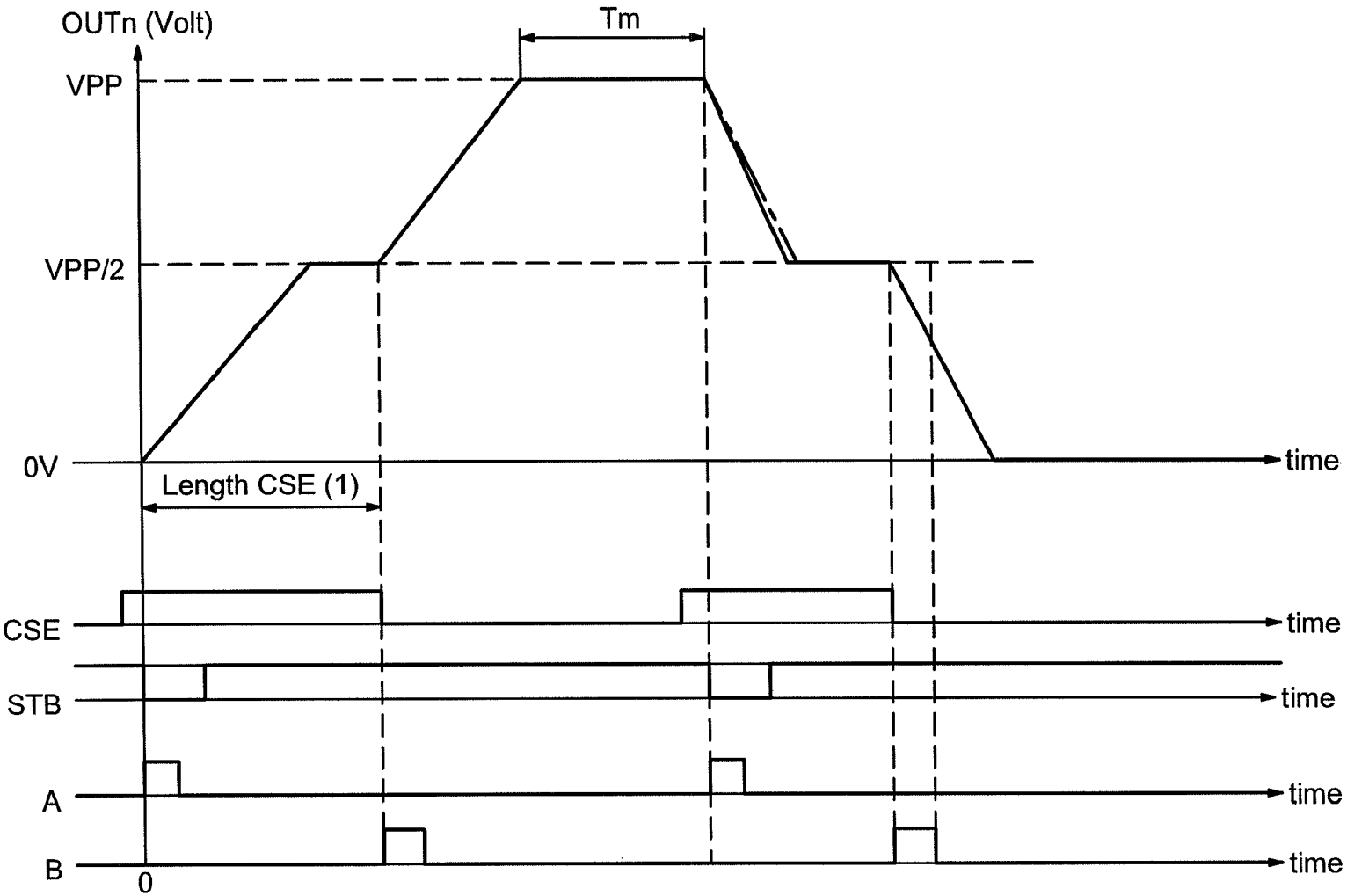
FIG. 8 illustrates a column selection and deselection signal according to the mode termed "charge sharing" as a function of various control signals.

A timechart represented in FIG. 8 represents the shape of the signals A and B as well as their impact on the evolution of the signal OUTn during selection then deselection of the column COLn. When the CSE mode is selected (the CSE signal goes to "1"), if the column COLn has to be selected. The selection signal starts at the falling edge of the signal STB (STB="0"). At this moment, a pulse of the signal A is generated. The selection signal OUTn then increases between 0 volts and VPP/2, at which voltage the intermediate porch appears (the breaker MM is on and the transistors MH and ML are off). As detailed above, this first part of the selection signal corresponds to the discharging of the charging capacitor incorporated into the circuit, according to the CSE mode.

The time Tm represents the minimum selection (or deselection) time necessary for the display. Then, when the CSE signal reverts to "0", a pulse of a signal B is generated, in such a way that the selection signal OUTn goes from VPP/2 to VPP (the transistor MH is on, the transistor ML is off, and the breaker MM is open). Then when the column is deselected, the same process repeats between VPP and VPP/2 (the breaker MM is on and the transistors ML and MH are off) then between VPP/2 and 0 volts (the transistor ML is on, the transistors MH is off, and the breaker MM is open). During a column selection, the "CSE length" (1) comprises the portion lying between the start of the signal and the end of the porch.

Figure 9:
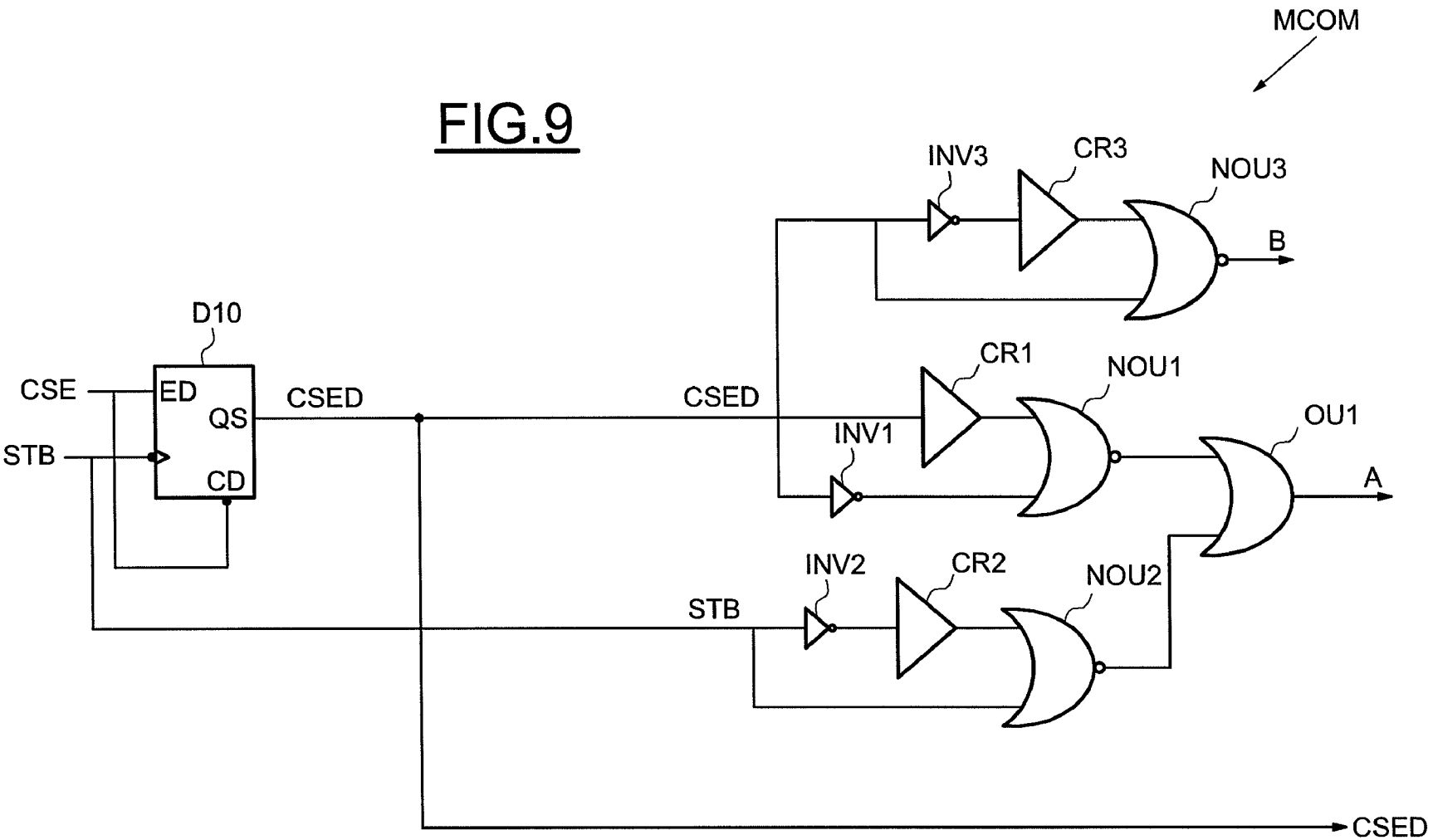
FIG. 9 illustrates more particularly an embodiment of the control means.

Accordingly, the control means MCOM, an embodiment of which is represented in greater detail in FIG. 9, comprise a D-type flip-flop, referenced D10. The latter receives the CSE signal on its D input. It is regulated by the signal STB. The flip-flop D10 is reset to zero when the CSE signal reverts to zero, by virtue of its inverting input CD. The output QS of the flip-flop D10 delivers a signal CSED as output. It takes the value of the CSE signal at the falling edge of the signal STB, and drops back to zero when the CSE signal takes the value zero.

The signal CSED is in particular used to formulate the signals An and B. For this purpose, the signal CSED is simultaneously delivered to a first inverter INV1 and a first delay cell CR1. The output of this inverter INV1 and of this delay cell CR1 are each connected at input to a "NOT OR" logic gate referenced NOR1. The latter is followed by an "OR" logic gate, referenced OR1.

Additionally, another inverter INV2 receives the signal STB as input. The output of this inverter INV2 is linked to a second delay cell CR2 whose output is itself linked to another logic gate of "NOT OR" type, referenced NOR2. This logic gate NOR2 also receives the signal STB directly as input and delivers the signal STBPLS as output, which is delivered as input to the gate OR1.

The signal CSED is also delivered to a third inverter INV3 whose output is connected to a third delay cell CR3 (whose delay is equal for example to the delay introduced by the cells CR1 and CR2). The output of the delay cell CR3 is linked to the input of a logic gate of "NOT OR" type, referenced NOR3, which also receives the signal CSED as input. The logic gate NOR3 delivers the signal B as output.

On the basis of the signals STBPLS and of the output signal of the gate NOR1, the gate OR1 delivers the signal A.

Figure 10:
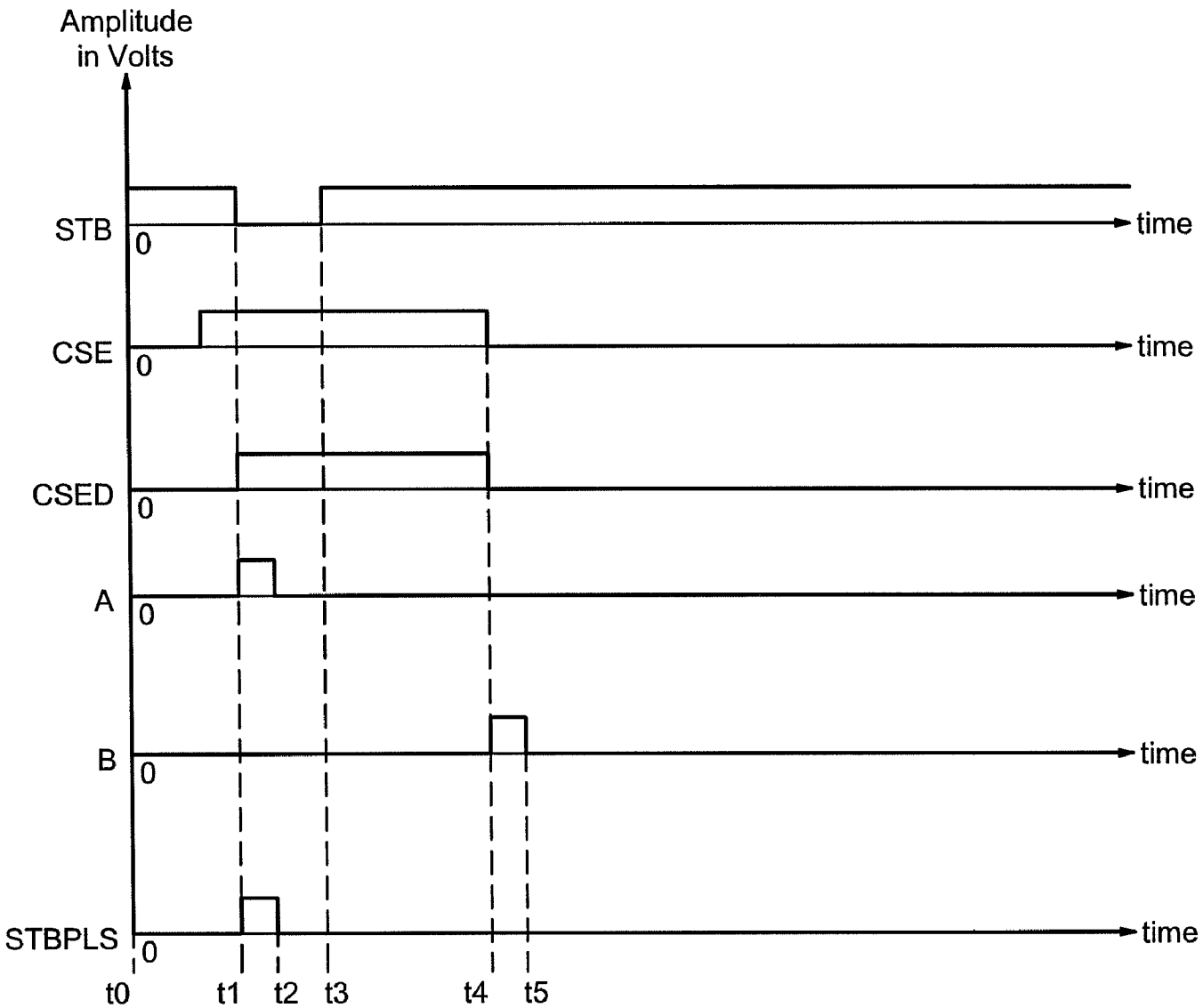
FIG. 10 represents a timechart of the variations in the signals generated by the control block illustrated in FIG. 9.

As represented on the timechart of FIG. 10, at the instant 0, the signal STB is equal to "1" and the signal STBPLS is equal to zero. Then, at the instant t1, the signal STB goes to "0", consequently the signal STBPLS goes to "1". At the instant t2, the signal STBPLS reverts to "0". The time gap between the instants t1 and t2 corresponds to the delay created by the delay cell CR2. At the instant t3, the signal STB reverts to "1". The output of the delay cell CR1 follows the evolution of the signal CSED with the delay introduced by the cell CR1. Consequently, the output of the logic gate NOR1 delivers the value "0" with the exception of the portion lying between the instants t1 and t2. Thus, the signal A takes the value "1" between the instants t1 and t2. The signal B takes the value "0" with the exception of the portion lying between the instants t4 and t5, where it takes the value "1".

Reference is once again made to FIG. 7*a*. After having determined the value of the column capacitance of the relevant column, the determination means MDET formulate an adjustment setpoint VAL on the basis of the aforesaid signals A, B and CSED. This setpoint VAL is delivered to a decoder DEC via means MAJ for adjusting the "CSE length". The decoder DEC has the function of formulating the signals SWM, SWH and SWL for controlling the transistors of the selection means MSn as will be seen in greater detail hereinafter.

Subsequently in the description, unless indicated to the contrary, for the sake of simplification it will be considered that the column COLn is deselected, and consequently the evaluation of a high column-capacitance comprises the detection of a rising edge for at least one of the columns COLn−1 or COLn+1. The person skilled in the art will very easily be able to adapt the device and the method to take into account the case of a selected column COLn.

Figure 11:
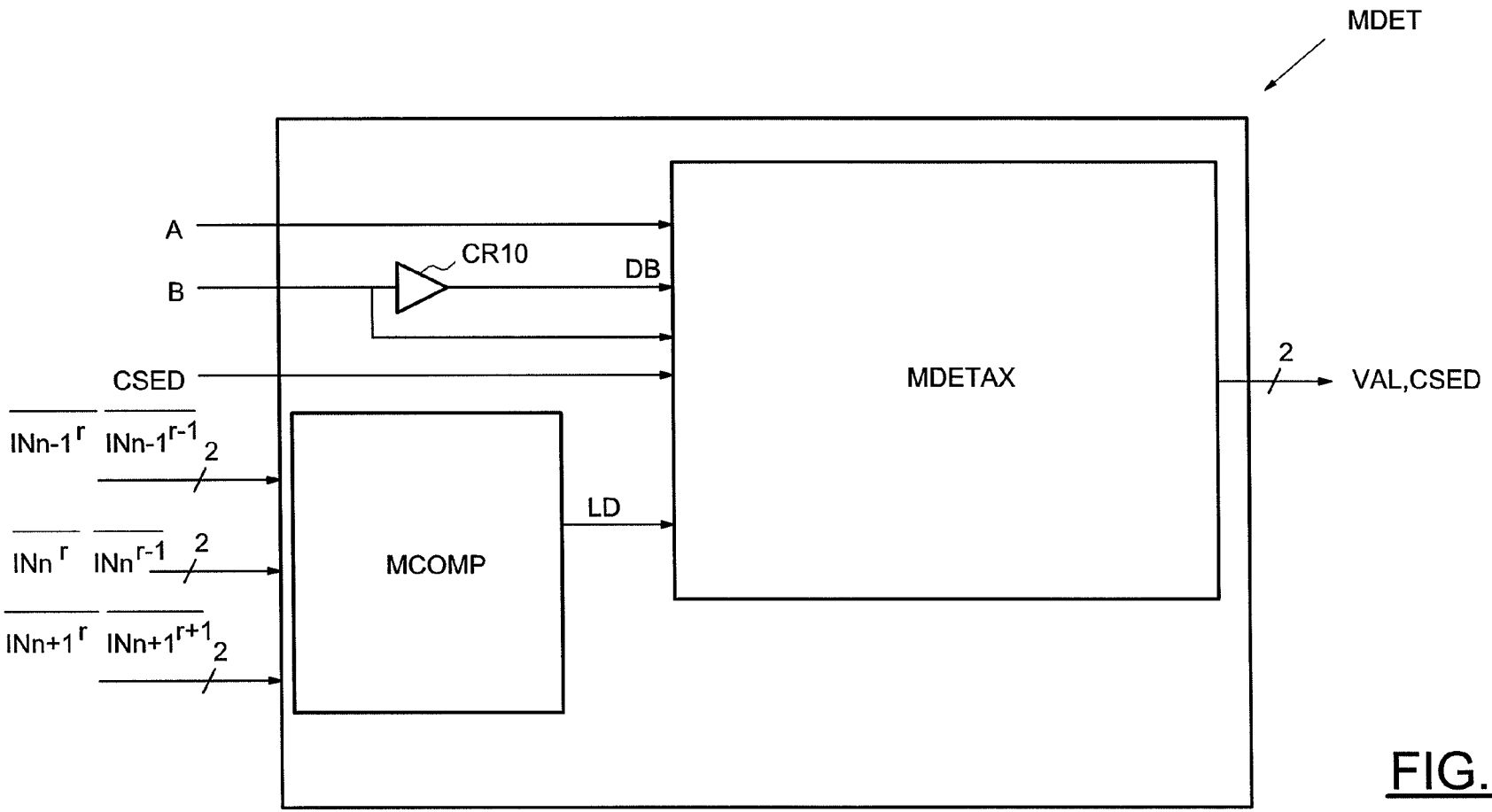
FIG. 11 illustrates an embodiment of the determination means.

As illustrated in FIG. 11, the determination means MDET comprise comparison means MCOMP able to evaluate whether the column-capacitance seen by the column COLn is greater or less than a given threshold, for example 60 pF. Accordingly, the means MCOMP receive the signals $\overline{INk^r}$, $\overline{INk^{r-1}}$, k taking the values n−1, n and n+1. The signals $\overline{INk^r}$ are obtained on the basis of the signals $INk^r$, with the aid of an inverter, not represented for the sake of simplification.

According to the example described above, for a falling edge of the column COLn, if at least one of the columns COLn−1 or COLn+1 goes from the low state to the high state between the selection of the rows Lr−1 and Lr (rising edge), the value of the column-capacitance is high.

The means MCOMP then deliver a signal LD representative of a low or high value of the column-capacitance. This signal is delivered to auxiliary determination means MDETAX, which also receive as input the signals A and B as well as the signal B delayed by a delay chosen with the aid of a delay cell CR10. This signal is referenced DB.

Figure 12:
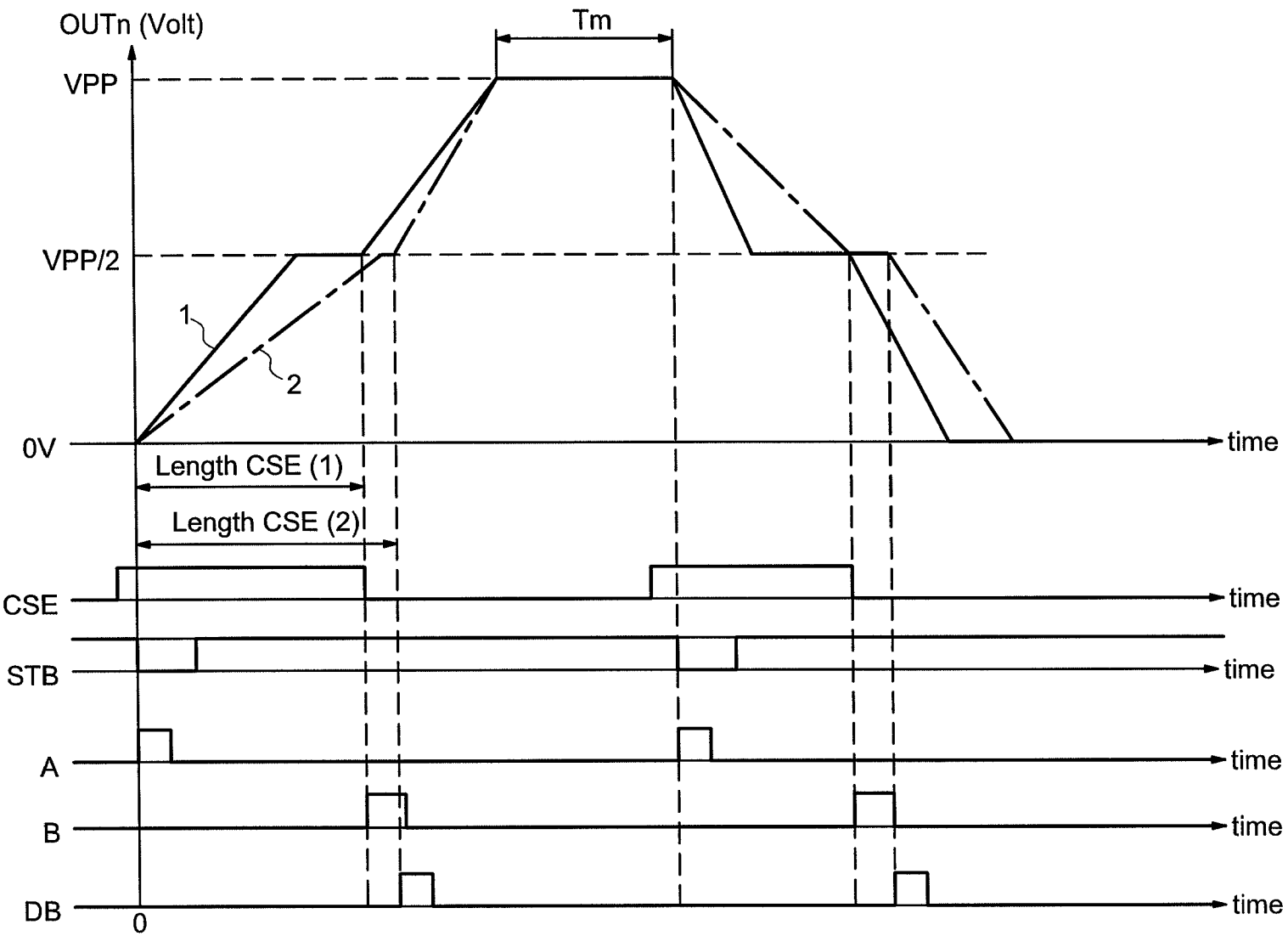
FIG. 12 illustrates the adjustment of the "CSE length" of the selection or deselection signals.

The adjustment of the "CSE length" with the aid of the signals A, B and DB is illustrated in FIG. 12. Curve 1 again gives the evolution of the signal OUTn as a function of the signals A and B as explained above, that is to say when the value of the column-capacitance is low. Curve 2 represents for its part the evolution of the signal OUTn as a function of the signals A and B and DB, when the column-capacitance of this column is particularly high. As may be seen, the slope value when starting the selection is particularly low, so that if the second part of the selection (or deselection) signal was triggered at the pulse of B, the intermediate porch would not appear.

In the event of a high value of the determined column-capacitance, the starting of the second part of the selection signal (or of the deselection signal) is then primed by the pulse of the delayed signal DB. The duration of the "CSE length (2)" is thus elongated with respect to that of the "CSE length (1)", thereby making it possible to preserve an intermediate porch for the selection and deselection signal.

Figure 13:
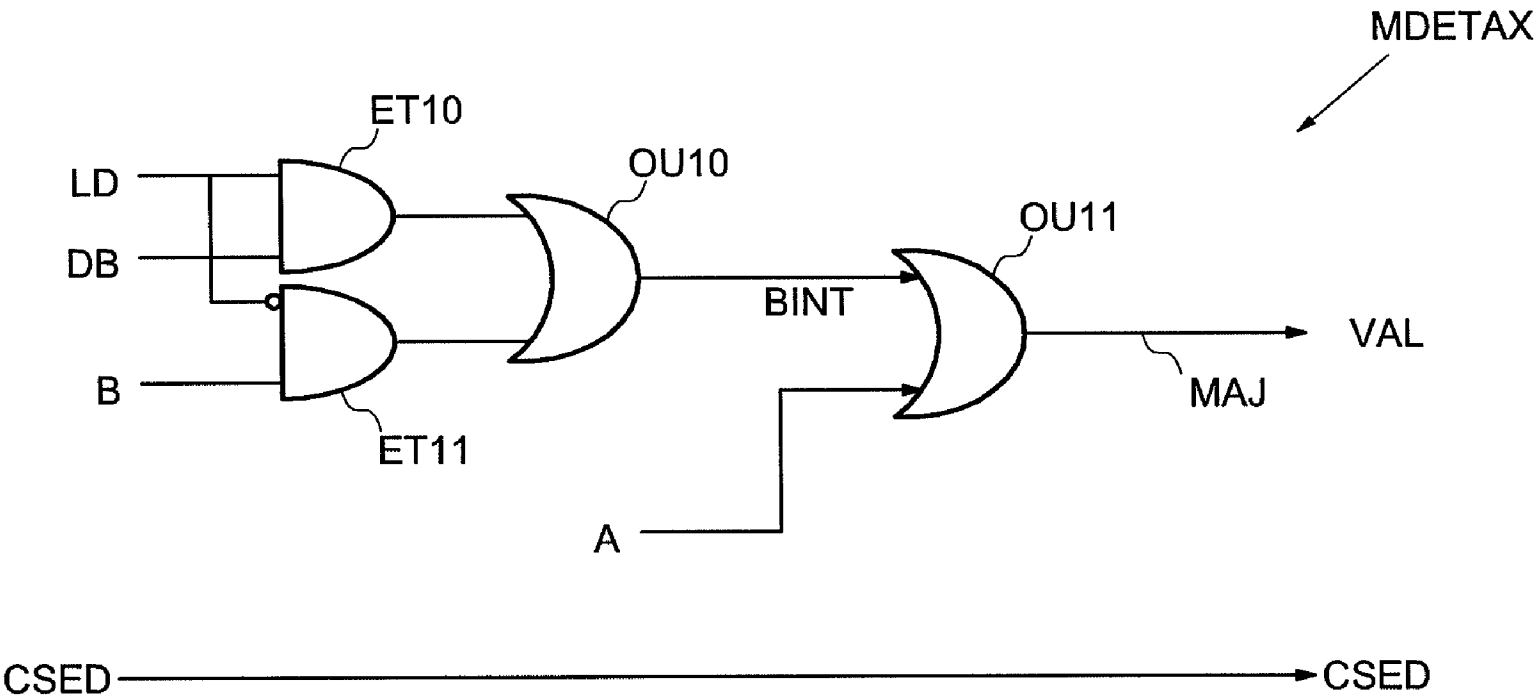
FIG. 13 illustrates in greater detail a part of the determination means represented in FIG. 11.

An embodiment of the auxiliary determination means is represented in FIG. 13. In this example, the auxiliary determination means MDETAX comprise a logic gate of "AND" type, referenced AND10, able to receive the signal LD and the signal DB. A second logic gate of "AND" type, referenced AND11, receives the signal LD on an inverting input and the signal B on another input. The output signals of the logic gates AND10 and AND11 are delivered as input to a logic gate of "OR" type, referenced OR10, which formulates the signal BINT.

A logic gate of "OR" type, referenced OR11, receives the intermediate signal BINT and the signal A as input, so as to formulate the signal VAL delivered by the adjustment means MAJ. The means MDETAX also deliver as output the signal CSED synchronized with the instant of delivery of the setpoint VAL, or indeed delivered with a slight advance. Thus, according to this embodiment, the setpoint VAL is formulated according to the equation:

$$VAL=A+BINT \quad \text{(equation 5)}$$

where BINT is an intermediate signal such that:

$$BINT=\overline{LD}\cdot B+LD\cdot DB \quad \text{(equation 6)}$$

Figure 14:
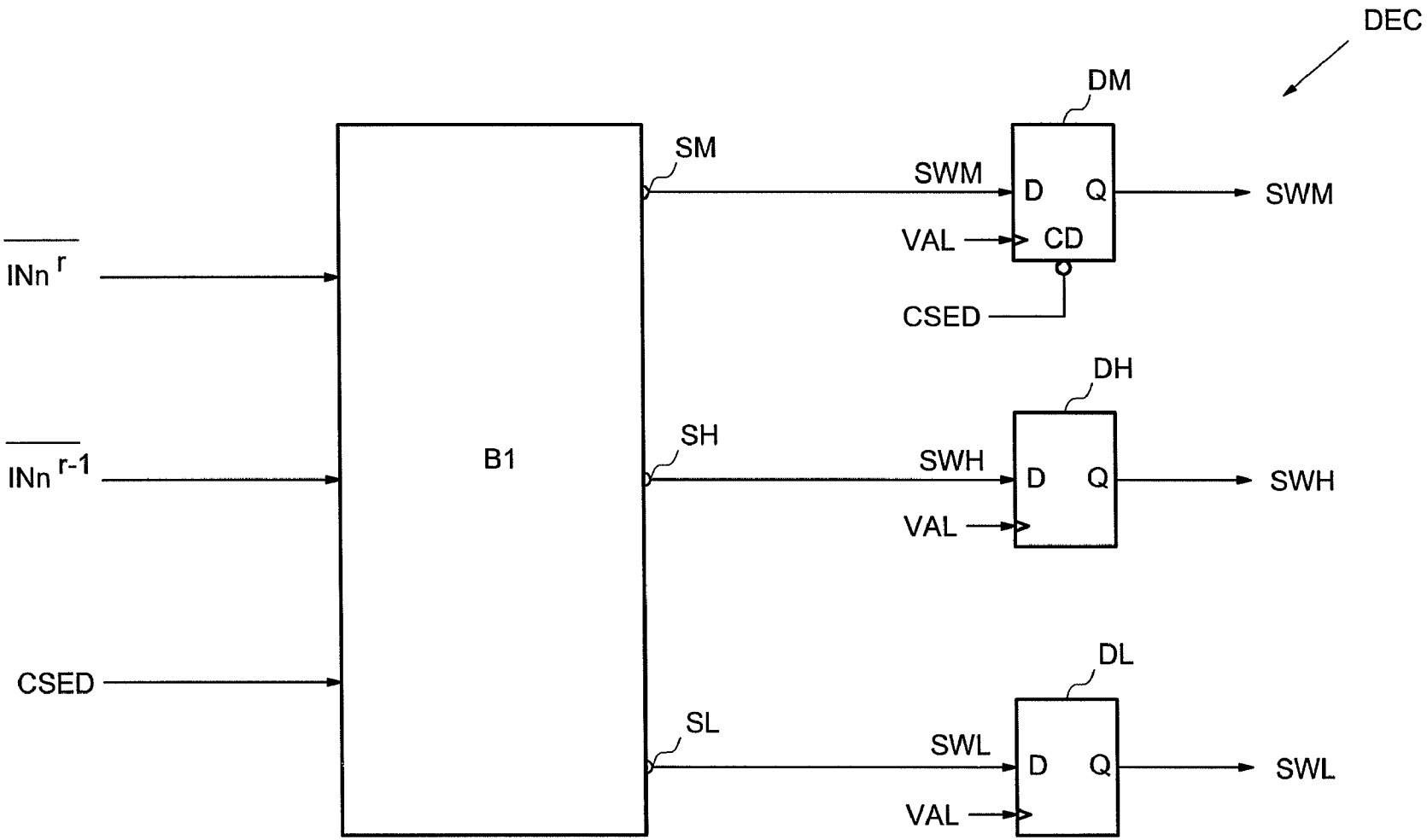
FIG. 14 illustrates an embodiment of a decoder able to control the transistors generating the signals for selecting and deselecting the columns.

The setpoint VAL and the signal CSED are delivered to the decoder DEC (see FIG. 7) which formulates the control signals SWH, SWM and SWL. An embodiment of a decoder is illustrated in FIG. 14. In this example, the decoder DEC comprises a block B1 receiving the signals $\overline{INn^r}$ and $\overline{INn^{r-1}}$ as well as the signal CSED as input.

The block B1 comprises three outputs, SM, SH and SL, respectively delivering the control signals SWM, SWH, SWL via three D-type flip-flops, DM, DH and DL respectively. Each of these flip-flops is regulated by the signal VAL. Stated otherwise, each flip-flop delivers its respective input signal when the setpoint VAL goes to the high state. Additionally, the flip-flop DM is initialized when the signal CSED goes to the low state.

The signal SWM is formulated according to the equation:

$$SWM=(INn^r\cdot\overline{INn^{r-1}}+\overline{INn^r}\cdot INn^{r-1})\cdot CSED \quad \text{(equation 7)},$$

the signal SWH according to the equation:

$$SWH=INn^r\cdot(\overline{CSED}+INn^{r-1}) \quad \text{(equation 8)},$$

and the signal SWL according to the equation:

$$SWL=\overline{INn^r}(\overline{CSED}+\overline{INn^{r-1}}) \quad \text{(equation 9)}.$$

Thus, as soon as a difference of state exists between the signals $INn^r$ and $INn^{r-1}$, and the signal CSED is at "1", the breaker MM (FIGS. 4*a* and 4*b*) is turned on. The transistor MH is turned on by the signal SWH when it is selected or when the relevant column is kept selected. Conversely, the transistor ML is turned on or is kept on by the signal SWL if the signal $INn^r$ goes to the low state or remains in the low state.

The foregoing can also apply to the column control blocks able to emit the selection or deselection signals with a delay (for example the lag of a given delay cell) between the starts of two successive signals, according to the mode commonly called "jitter" by the person skilled in the art.

If a high column-capacitance is detected, the elongation of the "CSE length" as well as the delay generated by the "jitter" mode for selection or deselection can cause the time Tm for which the column is kept selected or deselected to drop below the minimum time required. It is thus proposed to adjust the temporal evolution characteristics, namely the delay related to the application or otherwise of the "jitter" mode, and the "CSE length", as a function of the determined column capacitance. The successive selection or deselection of the columns ("jitter") makes it possible to reduce the current spikes within the screen, generated by the simultaneous selection or deselection of a large number of columns.

Figure 15:
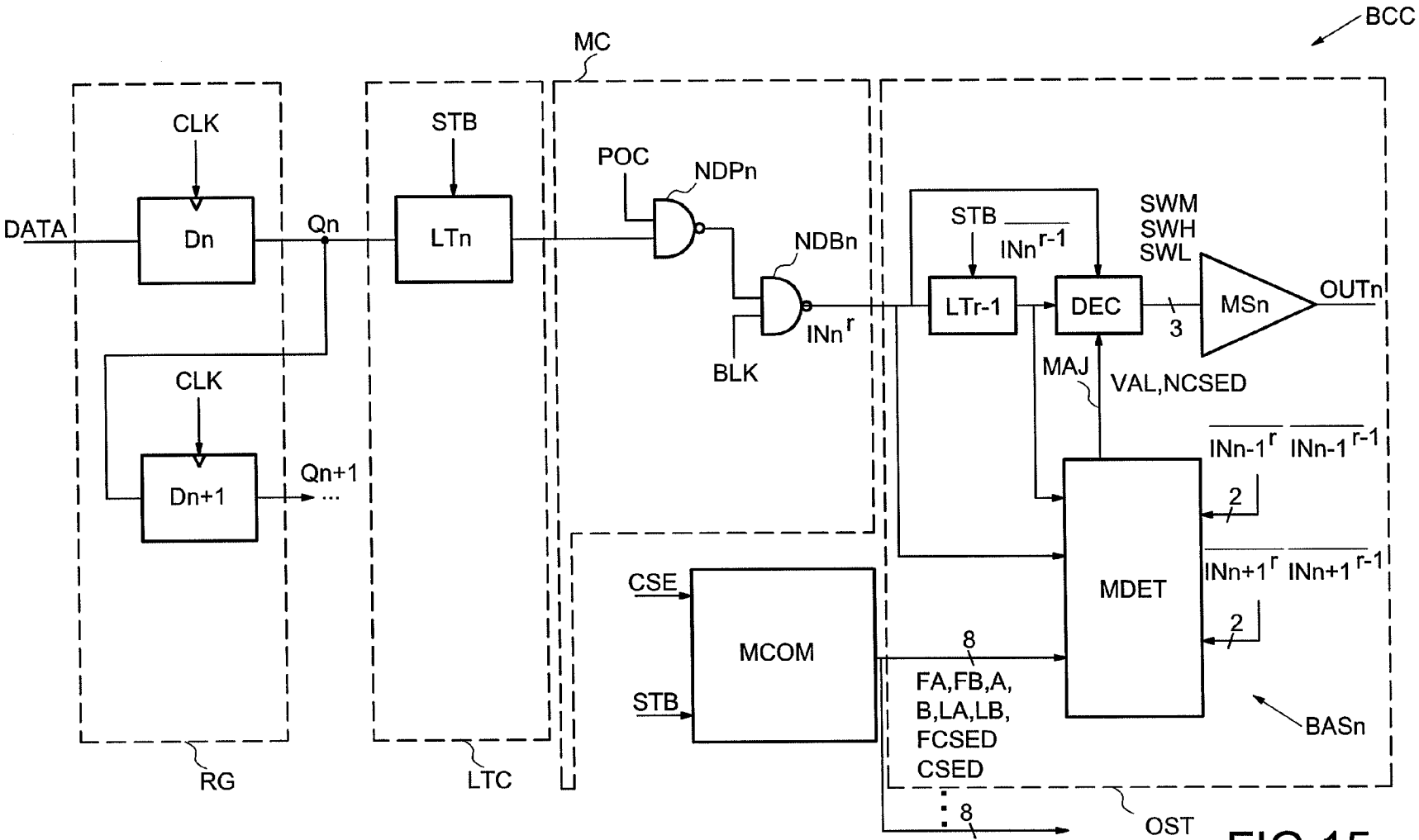
FIG. 15 illustrates another embodiment of a part of the column control block for a column n, according to the invention, applied to the case of the driving of selection and deselection signals generated, according to the "jitter" and CSE modes combined.

As illustrated in FIG. 15, in this embodiment, the control means MCOM deliver signals FA and FB priming the selection and deselection signals for the first column to be selected or deselected, signals A and B priming the selection and deselection signals of the relevant column COLn, signals LA and LB priming the selection and deselection signals of the last column to be selected or deselected. The control means MCOM also deliver the signal CSED for the relevant column COLn, formulated as described above, and the signal FCSED corresponding to the signal CSED for the first selected or deselected column.

Figure 16:
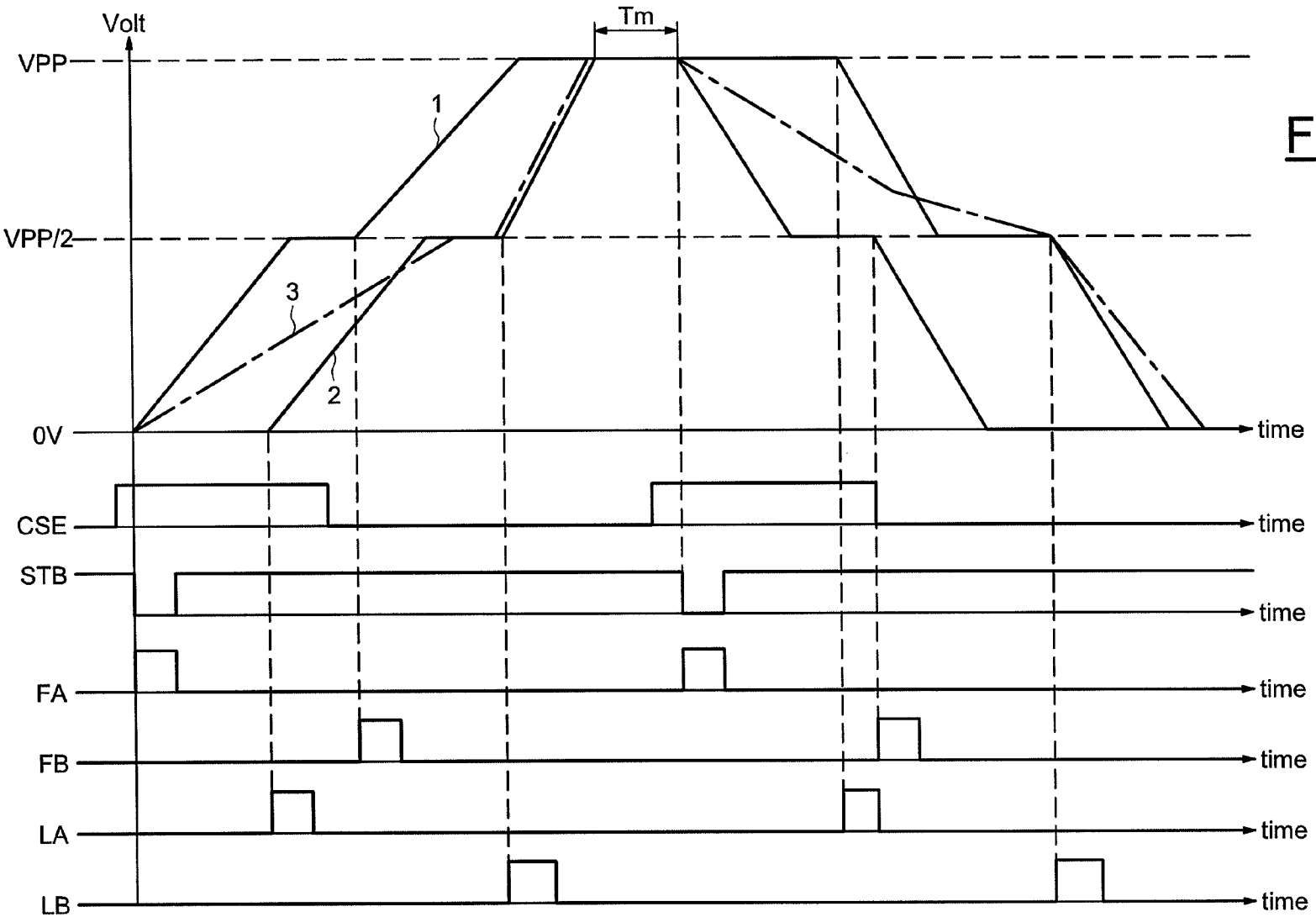
FIG. 16 illustrates the evolution of a column selection and deselection signal, in the case where the "jitter" mode is combined with the CSE mode.

Referring now to FIG. 16, which illustrates various signals for selecting then for deselecting a column, according to the CSE mode, in the case where the mode termed "jitter" is selected. More precisely, curves 1 and 2 of OUTn correspond to a deselection then a deselection respectively of the first and of the last column in the case where a low column-capacitance has been determined: the "jitter" mode is applied; the columns are therefore selected or deselected successively. The pulses of the signals FA and FB make it possible to trigger the first and the second part of the selection and deselection signal of the first column (curve 1). The pulses of the signals LA and LB make it possible to trigger the first and the second parts of the selection and deselection signal of the last column (curve 2). Curve 3 represents the variation of a selection then deselection signal, for an arbitrary column of the screen, in the case where the column-capacitance of the relevant column is particularly high.

As may be seen, the slope value of the first portions of the selection and deselection signal is much lower. Thus, if the second part were triggered during the pulse of FB, the intermediate porch would not be formed. Furthermore, for the last selected or deselected column, the minimum duration Tm for ensuring the selection or the deselection of the column would not be attained. Consequently, it is possible, when a high column-capacitance value is detected, to remove the "jitter" mode and to prime each first part of the whole set of selection and deselection signals according to the pulses of the signal FA, and each second part of the whole set of selection and deselection signals according to the pulses of the signal LB.

Figure 17:
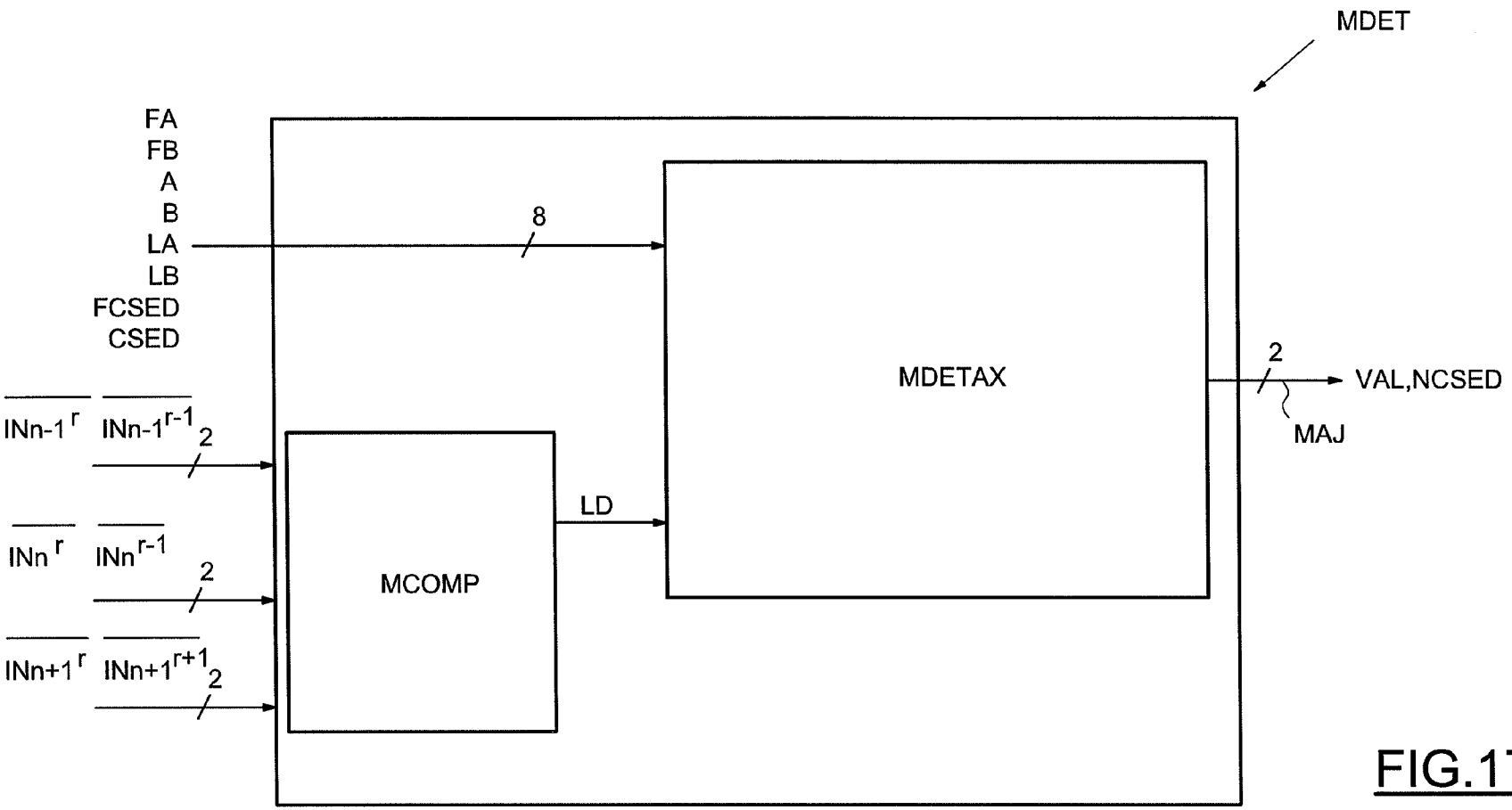
FIG. 17 more precisely illustrates an embodiment of a part of the column control block determination means represented in FIG. 15.

FIG. 17 represents an exemplary embodiment of the auxiliary determination means MDETAX in this particular case. The latter means receive the signals FA, FB, A, B, LA, LB, FCSED and CSED. They deliver as output a signal NCSED and the adjustment setpoint VAL as a function of the input signals and of the signal LD representative of a low or high column-capacitance value.

Figure 18:
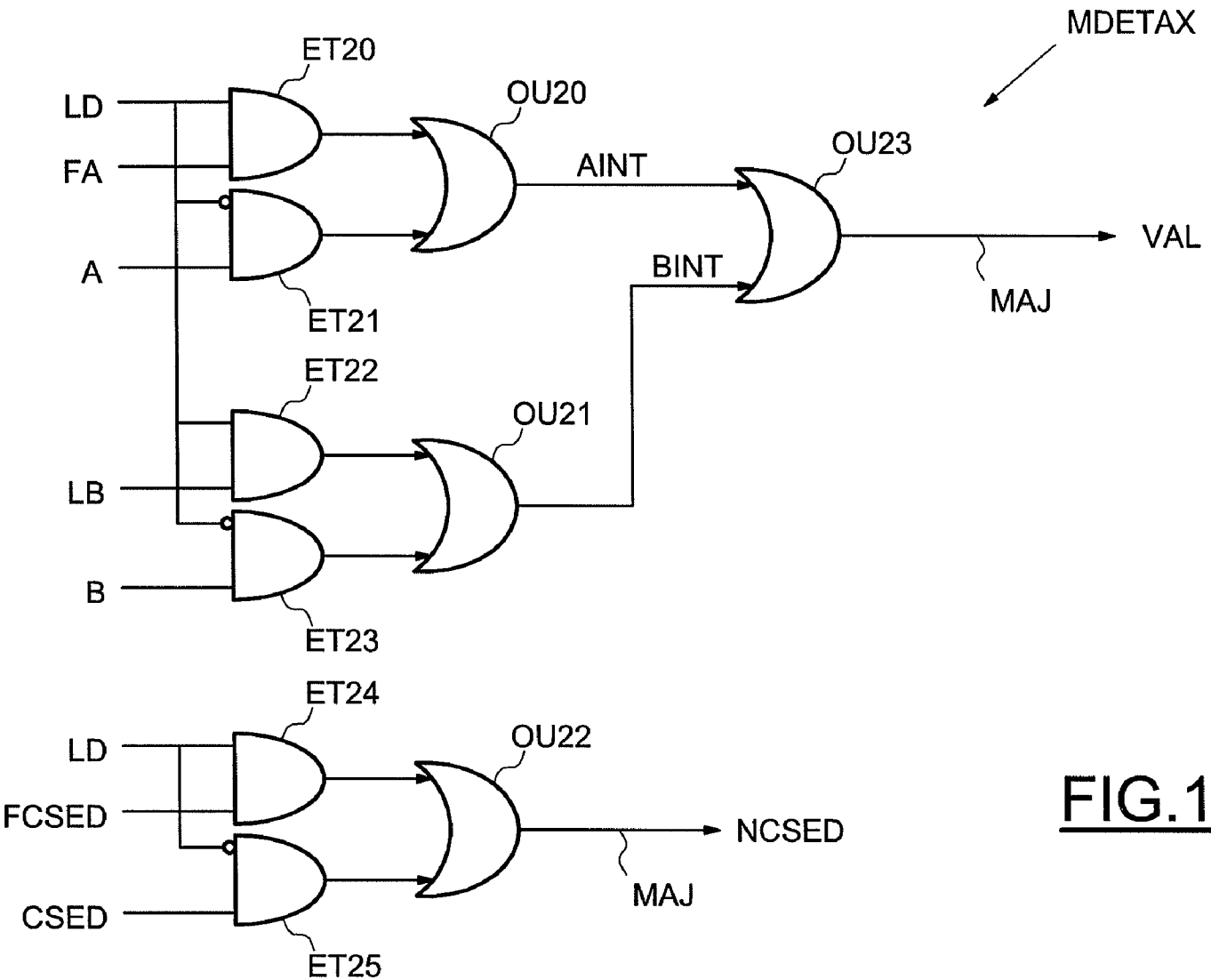
FIG. 18 more precisely illustrates the part of the determination means represented in FIG. 17.

More precisely, as illustrated in FIG. 18, the determination means MDETAX comprise a logic gate of "AND" type, referenced AND20, receiving as input the signal FA and the signal LD representative of a high or otherwise column-capacitance for the relevant column COLn. A second logic gate of "AND" type, referenced AND21, receives the signal LD on an inverting input and the signal A on another input. A third logic gate of "AND" type, referenced AND22, receives the signal LD and the signal LB as input. Finally, a fourth logic gate of "AND" type, referenced AND23, receives the signal LD on an inverting input and the signal B on another input.

The outputs of the logic gates AND20 and AND21 are connected as input to a logic gate of "OR" type, referenced OR20, delivering the signal AINT as output. Likewise, the outputs of the logic gates AND22 and AND23 are connected as input to a logic gate of "OR" type, referenced OR21 and delivering the signal BINT as output. The signals AINT and BINT are delivered as input to a logic gate of "OR" type, referenced OR23, so as to formulate the setpoint VAL.

Additionally, the auxiliary determination means MDETAX also comprise a logic gate of "AND" type, referenced AND24, receiving the signal LD and the signal FCSED as input, and another logic gate of "AND" type, referenced AND25, receiving the signal LD on an inverting input and the signal CSED on another input. The outputs of the logic gates AND24 and AND25 are connected as input to a logic gate of "OR" type, referenced OR22, formulating the signal NCSED.

It follows from the circuit described above, that the auxiliary determination means MDETAX formulate the setpoint VAL, according to the following equation:

$$VAL=AINT+BINT \quad \text{(equation 10)}$$

where the signal AINT is formulated according to the following equation:

$$AINT=LD\cdot FA+\overline{LD}\cdot A \quad \text{(equation 11)}$$

and the signal BINT according to the following equation:

$$BINT=\overline{LD}\cdot B+LD\cdot LB \quad \text{(equation 12)}$$

The signal NCSED is formulated by the auxiliary determination means MDET AX, according to the following equation:

$$NCSED=LD\cdot FCSED+\overline{LD}\cdot CSED \quad \text{(equation 13)}$$

As a variant, the adjustment of the temporal characteristics of the selection or deselection signals of a column control block can comprise the adjustment of the slope value when starting the selection and deselection signals, so as to compensate for the decrease caused by a high value of the column capacitances.

Figure 19:
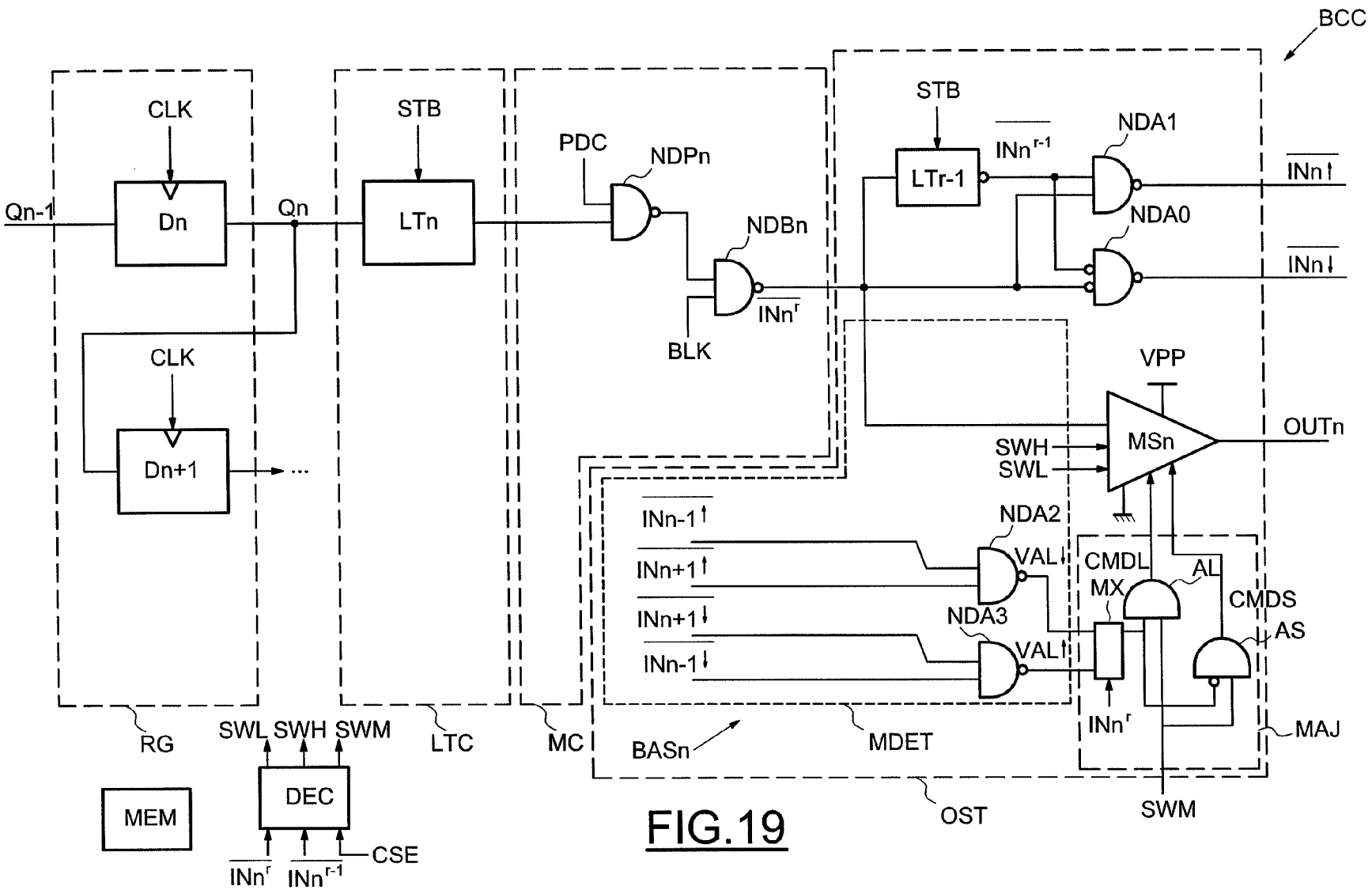
FIG. 19 illustrates another embodiment of a part of the column control block for a column n able to adjust the slope value when starting the selection or deselection signal.

Reference is made to FIG. 19 illustrating an embodiment of the column control block BCC for the implementation of this variant. This embodiment incorporates the case where the column COLn is deselected or selected.

The auxiliary output block BASn comprises in addition to the latch LTr−1: a first logic gate of "NOT AND" type, referenced NDA1, receiving the signals $\overline{INn^{r-1}}$ and $\overline{INn^{r}}$, so as to generate the signal $\overline{INn\uparrow}$, and another logic gate of "NOT AND" type referenced NDA0, having two inverting inputs. The gate NDA0 receives the signals $\overline{INn^{r}}$ and $\overline{INn^{r-1}}$ as input, and delivers the signal $\overline{INn^{r}\downarrow}$ as output, indicating that column n is deselected between two successive row selections.

Additionally, according to this embodiment, the determination means MDET comprise: a first logic gate, of "NOT AND" type, referenced NDA2, receiving the signals $\overline{INn-1\uparrow}$ and $\overline{INn+1\uparrow}$ as input, and delivering an adjustment setpoint VALE to the adjustment means MAJ, and a second logic gate, of "NOT AND" type, referenced NDA3, receiving the signals $\overline{INn-1}\downarrow$ and $\overline{INn+1}\downarrow$ as input, and delivering an adjustment setpoint VAL↑ to the adjustment means MAJ.

If the signal VAL↓ takes the value "1" (for example), this signifies that the value of the column-capacitance seen by the column COLn is high, within the framework of a deselection of this column. If the signal VAL↑ takes the value "1" (for example), this signifies that the value of the column-capacitance seen by the column COLn is high, within the framework of a selection of this column.

The signals SWL, SWH and SWM are formulated by the decoder DEC on the basis of the signals $\overline{INn^r}$ and $\overline{INn^{r-1}}$ and CSE. The signals SWH and SWL are delivered to the selection means MSn. The signal SWM is delivered to the adjustment means MAJ.

It is recalled that in the case of a deselected column COLn, the presence of at least one rising edge in the control signals of the neighboring columns COLn−1 and COLn+1, implies that the column-capacitance seen by the column COLn is high. Conversely, in the case of a selected column COLn, the presence of at least one falling edge in the control signals of the neighboring columns COLn−1 and COLn+1, implies that the column-capacitance seen by the column COLn is high.

The adjustment means MAJ comprise a multiplexer MX receiving the signals VAL↑ and VAL↓ as input, and being controlled by the signal $INn^r$. Thus, depending on whether the signal $INn^r$ indicates that the column COLn is selected or deselected, the multiplexer MX delivers an adjustment setpoint VAL taking a value "1" in the event of high column-capacitance value, corresponding to the signal VAL↑ (column COLn selected, therefore INnr is in the high state and the signal SWM is active) or to the signal VAL↓ (column COLn deselected therefore INnr is in the low state and the signal SWM is active).

Additionally, the adjustment means MAJ comprise a first logic gate of "AND" type, referenced AL, receiving the adjustment setpoint VAL delivered by the multiplexer MX, and the signal SWM as input, and delivering a control signal CMDL. A second logic gate of "AND" type, referenced AS, receives the adjustment setpoint VAL on an inverting input, and the signal SWM on another input. It delivers a control signal CMDS as output.

When the signal SWM is active (that is to say it takes the value "1") and the setpoint VAL also takes the value "1", indicating that the determined column-capacitance is high (in the case of selection or of deselection), the "AND" gate delivers a signal CMDL taking the value "1". Conversely, when the value of the setpoint VAL is equal to "0" indicating that the determined column-capacitance is low, the logic gate AS delivers a signal CMDS taking the value "1" (CMDL being set to "0").

Figure 20:
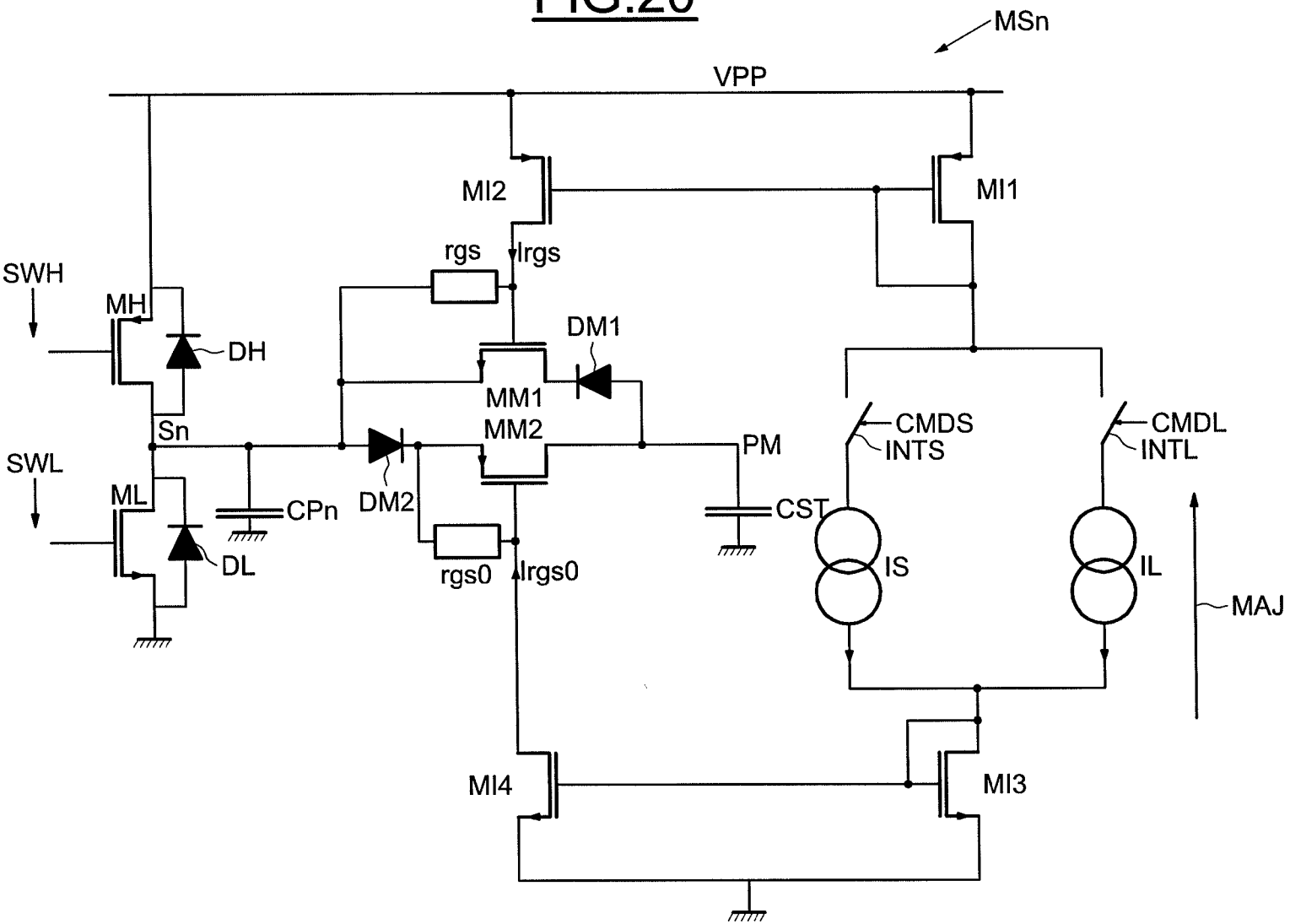
FIG. 20 more precisely illustrates an embodiment of a part of the stage supplemented with the column control block for a column n, represented in FIG. 19.

As represented in FIG. 20, the selection means MSn comprise for this variant, two current sources, IS and IL. In this example, the breaker MM is formed of an NMOS transistor MM1 and of an NMOS transistor MM2, used for selection and deselection respectively. The drain of the transistor MM1 is linked to the mid-point PM via a protection diode DM1, and its source is linked to the output Sn. A resistance rgs is connected between its gate and the output Sn. The source of the transistor MM2 is linked to the mid-point PM via a protection diode DM2, and its drain is linked to the output Sn. A resistance rgs0 is connected between its gate and the output Sn.

Each current source IS and IL comprises a first terminal linked to a first conventional current mirror structure formed of two transistors MI1 and MI2 and a second terminal linked to a second conventional current mirror structure formed of two transistors MI3 and MI4. Two breakers INTS and INTL respectively link the current sources IS and IL to the current mirror. These breakers INTS and INTL are respectively controlled by the signals CMDS and CMDL delivered by the adjustment means MAJ. The value of the current delivered by the source of the current IL is much greater than the value of the current delivered by the source IS.

The transistor MI1 is here a transistor of PMOS type, receiving the supply voltage VPP on one of its terminals (drain). It is connected by its other terminal (source) to the common node formed between the two current sources IS and IL. Its source is looped back to its gate.

The gate of the second transistor of the current mirror MI2 is linked to the gate of the transistor MI1. The transistor MI2 is also of PMOS type. Its source receives the supply voltage VPP and its drain is connected to the gate of the transistor MM1.

The first current mirror MI1, MI2 delivers a current Irgs on the gate of the transistor MM1, so as to effect the first part of the selection (between 0 and VPP/2). The transistor MI3 is here a transistor of NMOS type, one of whose terminals (source) is earthed (grounded). It is connected by its other terminal (drain) to the common node formed between the two current sources IS and IL. Its drain is looped back to its gate. The gate of the other transistor of the current mirror MI4 is linked to the gate of the transistor MI3. The transistor MI4 is also of NMOS type. Its source is earthed and its drain is linked to the gate of MM2.

The second current mirror MI3, MI4 delivers a current Irgs0 on the gate of the transistor MM2 so as to effect the first part of the deselection (between VPP and VPP/2). When a strong charge is determined by the determination means MDET, the signal CMDL causes the breaker INTL to close (the breaker INTS being open). The value of the current Irgs or Irgs0 depending on the case considered, is therefore equal to the value of the current delivered by the current source IL, said current being copied by the corresponding current mirror.

The slope value of the part of the selection or deselection signal, respectively lying between 0 volts and VPP/2 or between VPP and VPP/2, is therefore greater than the slope value obtained if the value of the current Irgs or Irgs0 had not been increased.

In the event that the column COLn is selected, the transistor MM1 is controlled on its gate by the current Irgs, so as to transfer the charge from the capacitor CST to the output Sn. Conversely, in the event of deselection, the transistor MM2 is controlled on its gate by the current Irgs0, so as to transfer the charge from the output Sn to the capacitor CST. If the determination means MDET do not determine any high column-capacitance value, the selection and deselection of the column COLn is effected with the current delivered by the source IS whose value is much lower than that of the current delivered by the current source IL.

The embodiments described above are wholly nonlimiting. For example, the circuits represented are not limited to the embodiments proposed.

The detection of a strong or of a weak charge can be applied for the adjustment of various temporal evolution characteristics of the selection or deselection signals emitted according to the CSE mode. It is not limited to the embodiments described above.

The detection of a high column capacitance for a given column COLn can bring about an adjustment of the temporal evolution characteristics of the selection or deselection signals of the whole set of columns COL1-COLN of the screen.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A method of controlling a matrix screen, comprising:

successively scanning the screen, each scan of the screen comprising a successive selection of the rows of the screen, and for each selected row, a selection or a deselection of a set of columns of the screen with the aid of column selection or deselection signals, wherein a temporal evolution of each selection signal and of each deselection signal of each column comprises a first and a second part separated by an intermediate porch, for each column to be selected or deselected, determining the value of the capacitance seen by the column, and adjusting the temporal evolution characteristics of the selection or deselection signal of at least one column to be selected or deselected, as a function of the determined value of its column-capacitance.

2. The method according to claim 1, further comprising adjusting the temporal evolution characteristics of the selection or deselection signal of the other columns to be selected or deselected as a function of the value of the column-capacitance determined for the column.

3. The method according to claim 1, comprising adjusting the temporal evolution characteristics of the selection or deselection signal of each column to be selected or deselected as a function of the determined value of its own column-capacitance.

4. The method according to claim 1, wherein temporal evolution characteristics of the selection or deselection signals at least of the column to be selected or deselected are adjusted if the value of its column-capacitance lies in a chosen span of values.

5. The method according to claim 1, wherein temporal evolution characteristics of the selection or deselection signals at least of the column to be selected or deselected are adjusted if the value of its column-capacitance is greater than a chosen threshold.

6. The method according to claim 1, wherein adjusting the temporal evolution characteristics of the selection or deselection signals comprises an increasing or a decreasing in a duration of the portion comprising the first part and the intermediate porch of the relevant selection or deselection signal.

7. The method according to claim 1, wherein adjusting the temporal evolution characteristics of the selection or deselection signal comprises an increasing or a decreasing in an absolute value of the slope value of the first respective parts of the relevant selection or deselection signal.

8. The method according to claim 1, wherein for a selected row, each selection or deselection signal is successively emitted with a chosen lag between the starts of two successive signals, and wherein adjusting the temporal evolution characteristics of the selection or deselection signal comprises zeroing of the successive lags between each selection or deselection signal successively emitted.

9. The method according to claim 1, wherein determining the value of a column-capacitance is carried out on the basis of signals representative of possible changes of state of the selection or deselection signals of at least the columns flanking the column by taking account of the direction of variation of the selection or deselection signal of the column.

10. A device for controlling a matrix screen, comprising:

scanning circuitry comprising a row control block which successively selects each row, and at least one column control block which, for each selected row, selects or deselects a set of columns of the screen, with the aid of column selection or deselection signals, wherein a temporal evolution of each column selection signal and of each column deselection signal comprises a first and a second part separated by an intermediate porch, and wherein the column control block comprises, for each column of the screen, a determination circuit which at least if the corresponding column has to be selected or deselected, determines the value of the capacitance seen by the column termed the column-capacitance, and an adjustment circuit which adjusts temporal evolution characteristics of the selection or deselection signal of at least one column to be selected or deselected as a function of the determined value of its column-capacitance.

11. The device according to claim 10, wherein the adjustment circuit further adjusts temporal evolution characteristics of the selection or deselection signal of the other columns to be selected or deselected as a function of the value of the column-capacitance determined for the column.

12. The device according to claim 10, wherein the adjustment circuit further adjusts temporal evolution characteristics of the selection or deselection signal of each column to be selected or deselected as a function of the determined value of its own column-capacitance.

13. The device according to claim 10, further comprising a storage circuit which stores a chosen span of values, the adjustment circuit adjusting temporal evolution characteristics of the selection or deselection signals at least of the column to be selected or deselected if the value of its column-capacitance lies in the stored chosen span of values.

14. The device according to claim 10, further comprising a storage circuit which stores a chosen threshold, the adjustment circuit adjusting temporal evolution characteristics of the selection or deselection signals at least of the column to be selected or deselected if the value of its column-capacitance is greater than the stored chosen threshold.

15. The device according to claim 10, wherein the adjusting circuit delivers an adjustment setpoint so as to increase or decrease the duration of the portion comprising the first part and the intermediate porch of the relevant selection or deselection signal as a function of the value determined for the relevant column-capacitance.

16. The device according to claim 15, further comprising a control circuit coupled upstream of the determination circuit which delivers for each selection or deselection signal a first and a second signal that prime the first and the second part of the selection or deselection signal, and wherein the determination circuit further formulates for each selection or deselection signal a third signal delayed with respect to the second signal, the third signal priming the second part of the selection or deselection signal, the adjustment setpoint being representative of the first signal and of another signal corresponding to the second signal or to the third signal according to the value determined for the relevant column-capacitance.

17. The device according to claim 10, in which for a selected row, the column selection block emits each selection or deselection signal successively with a chosen lag between the starts of two successive signals, and wherein the adjustment circuit delivers an adjustment setpoint so as to zero the successive lags between each selection or deselection signal.

18. The device according to claim 17, further comprising a control circuit coupled upstream of the determination circuit which delivers for each selection or deselection signal a first and a second signal that prime the first and the second part of the selection or deselection signal, each of the first signals and each of the second signals being respectively delivered successively with the chosen lag between the starts of two first or of two second successive signals, and wherein the adjustment setpoint is representative of the first signal and of the second signal of the relevant column, or representative of the first signal of the first column to be selected and of the second signal of the last column to be deselected, according to the value determined for the relevant column-capacitance.

19. The device according to claim 10, in which the intermediate porch is generated with the aid of at least one intermediate transistor comprising a control electrode controlled by a control current with adjustable value, and wherein the adjustment circuit delivers an adjustment setpoint for the value of the current controllable as a function of the value determined for the relevant column-capacitance.

20. The device according to claim 19, wherein the adjustment setpoint comprises a first signal representative of a high column-capacitance value, and a second signal representative of a low column-capacitance value, and wherein the control electrode of the intermediate transistor is coupled to a first and to a second current source by way of a first and of a second breaker respectively controlled by the first and the second signal, the second current source delivering a current having a value less than the value of the current delivered by the first current source, and wherein the first signal controls the closing of the first breaker if the determined column-capacitance is high, the second breaker remaining open, and the second signal controls the closing of the second breaker if the determined column-capacitance is low, the first breaker remaining open.

21. The device according to claim 10, wherein the determination circuit determines the value of a column-capacitance on the basis of signals representative of possible changes of state of the selection or deselection signals of at least the columns flanking the column by taking account of the direction of variation of the selection or deselection signal of the column.

22. The device according to claim 21, wherein the determination circuit comprises a auxiliary determination circuit comprising:

a flip-flop receiving a selection or deselection control signal for the relevant column, and storing the state of the relevant column on the basis of the state of the control signal, and delivering the stored state of the column for the selection of the following row, a first comparison circuit which, for the relevant column, compares its present state and its state, stored in the flip-flop, for the previously selected row, to deliver a variable representative of the possible change of state of the selection or deselection signal.

23. A display screen system, comprising:

a display screen; and a screen controlling device, comprising:

scanning circuitry comprising a row control block which successively selects each row, and at least one column control block which, for each selected row, selects or deselects a set of columns of the screen, with the aid of column selection or deselection signals, wherein a temporal evolution of each column selection signal and of each column deselection signal comprises a first and a second part separated by an intermediate porch, and wherein the column control block comprises, for each column of the screen, a determination circuit which at least if the corresponding column has to be selected or deselected, determines the value of the capacitance seen by the column termed the column-capacitance, and an adjustment circuit which adjusts temporal evolution characteristics of the selection or deselection signal of at least one column to be selected or deselected as a function of the determined value of its column-capacitance.

24. The display screen system of claim 23 wherein the screen is a matrix plasma screen.

* * * * *